US007219633B1

(12) United States Patent
McLeod

(10) Patent No.: US 7,219,633 B1
(45) Date of Patent: May 22, 2007

(54) COMPRESSION IGNITION ROTATING CYLINDER ENGINE

(76) Inventor: Robert A McLeod, 8910 Fremont Ave. North, Seattle, WA (US) 98103

( * ) Notice: Subject to any disclaimer, the term of this patent is extended or adjusted under 35 U.S.C. 154(b) by 15 days.

(21) Appl. No.: 11/085,321

(22) Filed: Mar. 21, 2005

(51) Int. Cl.
*F01B 3/04* (2006.01)

(52) U.S. Cl. ..... 123/56.6; 123/56.2

(58) Field of Classification Search ..... 123/56.2, 123/55.2, 55.5, 56.6, 56.9, 57.1, 559.1
See application file for complete search history.

(56) References Cited

U.S. PATENT DOCUMENTS

| | | | | |
|---|---|---|---|---|
| 349,775 | A | 9/1886 | Wood | |
| 657,409 | A | 9/1900 | Gould | |
| 1,145,820 | A | 7/1915 | Summeril | |
| 1,332,948 | A | 3/1920 | Murphy | |
| 1,788,140 | A | 1/1931 | Woolson | |
| 1,808,083 | A | 6/1931 | Tibbetts | |
| 2,983,264 | A | 5/1961 | Herrmann | |
| 4,569,314 | A * | 2/1986 | Milu | 123/51 B |
| 4,635,590 | A * | 1/1987 | Gerace | 123/27 R |
| 4,996,953 | A | 3/1991 | Buck | |
| 5,507,253 | A * | 4/1996 | Lowi, Jr. | 123/56.9 |
| 5,743,220 | A * | 4/1998 | Guarner-Lans | 123/56.9 |
| 6,089,195 | A | 7/2000 | Lowi, Jr. | |
| 6,202,606 | B1 * | 3/2001 | Anttila | 123/56.1 |
| 6,575,125 | B1 | 6/2003 | Ryan | |
| 6,779,494 | B1 | 8/2004 | Aswani | |

FOREIGN PATENT DOCUMENTS

| | | |
|---|---|---|
| GB | 390.263 | 4/1933 |
| WO | WO98/41734 | 9/1998 |

* cited by examiner

*Primary Examiner*—Noah P. Kamen
*Assistant Examiner*—Jason Benton
(74) *Attorney, Agent, or Firm*—Michael I. Kroll

(57) ABSTRACT

A compression ignition rotating cylinder engine (CIRC), provides a design that has several distinct advantages over conventional internal combustion engines. Rotating cylinder blocks and a fixed header plate provide a more fuel-efficient engine with constant positive torque and reduced vibration.

9 Claims, 29 Drawing Sheets

COMPRESSION IGNITION ROTATING CYLINDER ENGINE

BACKGROUND OF THE INVENTION

1. Field of the Invention

The present invention relates generally to internal combustion engines and, more specifically, to a compression ignition rotating cylinder engine comprising two opposing cylinder blocks having piston assemblies, cam plates, a header plate and drive shaft. The cylinder blocks are cylindrical in shape and sandwich the header plate. The cylinder blocks rotate with the drive shaft which connects the cylinder blocks through the header plate. The drive shaft also connects the engine to the load and any auxiliary equipment. Each cylinder block contains multiple bores for a plurality of piston assemblies in a circular pattern around their axis. Each piston assembly comprises a piston head, a piston rod with a slider groove, a slider pin disposed within said slider groove for maintaining alignment of the piston during reciprocation, a spring and a cam roller. The reciprocating motion of the piston assemblies are controlled by the movement of the cam rollers along the cam plates which contain tracks for the cam rollers. The spring urges the cam roller towards the cam plate. The header plate contains a combustion chamber, intake and exhaust channels as well as flat portions for the piston to compress and expand gases against.

2. Description of the Prior Art

There are other internal combustion engines designed to provide continuous power output. Typical of these is U.S. Pat. No. 349,775 issued to Wood on Sep. 28, 1886.

Another patent was issued to Gould on Sep. 4, 1900 as U.S. Pat. No. 657,409. Yet another U.S. Pat. No. 1,145,820 was issued to Summeril on Jul. 6, 1915 and still yet another was issued on Mar. 9, 1920 to Murphy as U.S. Pat. No. 1,332,948.

Another patent was issued to Woolson on Jan. 6, 1931 as U.S. Pat. No. 1,788,140. Yet another U.S. Pat. No. 1,808,083 was issued to Tibbetts on Jun. 2, 1931 and still yet another was issued on May 9, 1961 to Herrmann as U.S. Pat. No. 2,983,264.

Another patent was issued to Buck on Mar. 5, 1991 as U.S. Pat. No. 4,996,953. Yet another U.S. Pat. No. 6,089,195 was issued to Lowi, Jr. on Jul. 18, 2000 and still yet another was issued on Jun. 10, 2003 as U.S. Pat. No. 6,575,125 to Ryan et al.

Another patent was issued to Aswani on Aug. 24, 2004 as U.S. Pat. No. 6,779,494. Yet another U.K. Patent No. GB390,263 was issued to Whyte on Apr. 6, 1933 and still yet another patent application was published on Sep. 24, 1998 as International Patent Application WO98/41734 to Bahnev et al.

U.S. Pat. No. 349,775

Inventor: William H. Wood

Issued: Sep. 28, 1886

In combination, a cylinder, a piston with its rod extending through both cylinder-heads and engaging curved cams at both its ends, and the curved cams fast to the main shaft, all substantially as described.

U.S. Pat. No. 657,409

Inventor: Alexander H. Gould

Issued: Sep. 4, 1900

An engine of the type described comprising a rotatable armature having a plurality of longitudinally-arranged piston-receiving grooves formed in its periphery, a casing inclosing the said armature and forming the outer wall of the said piston-receiving grooves, an inlet port and an exhaust-port in communication with said grooves, and pitmen carried by the pistons and working on inclined surfaces carried by the cylinder, substantially as described.

U.S. Pat. No. 1,145,820

Inventor: Frank H. Summeril

Issued: Jul. 6, 1915

In an internal combustion engine, a cylinder having admission ports at opposite sides of its center and an exhaust port at one side of the same, a rotary shaft, opposed pistons within the said cylinder in operative connection with the said shaft, a source of motive fluid in continuous communication with one of said admission ports, and a valve-controlled connection between the said source and the other admission port.

U.S. Pat. No. 1,332,948

Inventor: P. W. Murphy

Issued: Mar. 9, 1920

In an internal combustion engine, a cylinder, a piston therein provided with a piston rod, a case into which the rod extends for operation of the drive shaft, said case being adapted to be provided with a quantity of oil for supplying the operating parts therein, a baffle closing the cylinder to the case through which the piston rod extends, means for packing the rod to prevent passage of oil from the case into the cylinder, a chamber closed to the case there being a passageway provided between the chamber and the lower end of the cylinder whereby movement of the piston therein draws air through the chamber, said chamber being open to atmosphere and means of providing a supply of oil in the said chamber.

U.S. Pat. No. 1,788,140

Inventor: Lionel M. Woolson

Issued: Jan. 6, 1931

In an internal combustion engine, in combination, a cylinder, a piston movable in the cylinder and means for moving the piston on an idle stroke of the engine.

U.S. Pat. No. 1,808,083

Inventor: Milton Tibbetts

Issued: Jun. 2, 1931

In an internal combustion engine, in combination, a cylinder, a pair of opposed pistons movable in the cylinder, and cam means for moving the pistons in two idle strokes during a complete cycle.

U.S. Pat. No. 2,983,264

Inventor: Karl L. Herrmann

Issued: May 9, 1961

In an internal combustion engine having a rotatable shaft, a housing defining a series of combustion cylinders and a series of compression cylinders arranged with their axes parallel to said shaft and grouped around said shaft, said shaft including a cam, said shaft having a pressure chamber therein, a fuel flow control member for placing said compression chamber in communication with said chamber, means at the end of said compression cylinders adjacent said flow control member, said means restricting the flow of the air-fuel mixture between the compression cylinder and the chamber until the pressure within the compression cylinder rises a predetermined amount.

U.S. Pat. No. 4,996,953

Inventor: Erik S. Buck

Issued: Mar. 5, 1991

Combustion engines have opposed pistons in one or more cylinders, with the piston motion determined by cams. Ports, for intake and exhaust, are at one end of the cylinder, opened or closed by one piston, with the combustion chamber at the other end, and the engine being well suited to the optional use of a combustion chamber separate from the cylinder and with the communicating passages controlled by the other piston. That arrangement makes the engine particularly suitable for using heavy or unconventional fuels. The cam profile provides for a four-stroke cycle; one piston moves during the intake and exhaust strokes, while the second piston moves for compression and power strokes. Thus the advantages of a four-stroke engine are obtained while retaining the simplicity of a two-stroke engine. The cam profile may be tailored to the burning characteristics of the fuel, as by providing a period of dwell between the end of the compression stroke and the beginning of the power stroke. The engine is well suited to the use of compression ignition, but spark ignition is feasible. The isolated combustion chamber may also be replaced by a heat exchanger, to use an external heat source.

U.S. Pat. No. 6,089,195

Inventor: Alvin Lowi, Jr.

Issued: Jul. 18, 2000

An engine structure and mechanism that operates on various combustion processes in a two-stroke-cycle without supplemental cooling or lubrication comprises an axial assembly of cylindrical modules and twin, double-harmonic cams that operate with opposed pistons in each cylinder through fully captured rolling contact bearings. The opposed pistons are double-acting, performing a two-stroke engine power cycle on facing ends and induction and scavenge air compression on their outside ends, all within the same cylinder bore. The engine includes a novel combustion chamber configuration comprising a semi-torus formed by a peripheral relief provided around the outer perimeter of each piston crown. This arrangement leaves a large central surface or squish land on each piston crown permitting a small piston clearance to be used for the purpose of generating a strong, radially-outward flow (squish) as the pistons approach each other in their cyclic motions. The cross-section of the toroidal space may be varied from point to point about the perimeter to provide improved entrance regions for the fuel injection.

U.S. Pat. No. 6,575,125

Inventor: Lawrence J. Ryan

Issued: Jun. 10, 2003

The present invention is a barrel-type internal combustion engine. The engine is generally comprised of a plurality of cylinders arranged in in-line pairs, each in-line pair having a double headed piston therein. The cylinders are arranged surrounding a central shaft that has a cam thereon. The cam has two opposing sinusoidal surfaces extending outward and around the shaft for positioning the pistons in the cylinders and transferring the combustion energy to the output shaft. The cam has a plurality of alternating and equidistantly spaced rises and reverse rises forming each of the sinusoidal surfaces. The engine is constructed and arranged to align each rise and reverse rise with a cylinder such that the engine can produce a power stroke substantially simultaneously in each cylinder aligned with a rise and reverse rise.

U.S. Pat. No. 6.779,494

Inventor: Deepak Jayanti Aswani

Issued: Aug. 24, 2004

A multi-cylinder internal-combustion engine where translation between piston reciprocating motion and rotational motion occurs via a pair of conjugate axial cams with dual rolling followers on the piston-assemblies—one rolling follower per conjugate axial cam. A pair of conjugate axial cams form a grooved or ribbed axial cam that is form-closed and is frequently referred to as a barrel-cam. Balanced operation is ensured through a series of relative constraints between the number and masses of uniformly spaced piston-assemblies about the barrel-cam cylinder, the shape of the barrel-cam's piston-assembly displacement profile, and also the valve-assemblies along with their actuation properties.

U.K. Patent Number GB390,263

Inventor: John Whyte et al.

Issued: Apr. 6, 1933

Multi-cylinder crankless engines suitable for steam or oil, characterized in the provision of a frame, any suitable number of pairs or cylinders opposite to each other and attached to the frame, a piston-rod by which the piston of each pair of opposite cylinders are connected together and the valves of each pair of opposite cylinders are controlled by a single valve-rod, and pins attached to the centre portion of each piston-rod, to which pins rollers are attached.

International Patent Application Number WO 98/41734

Inventor: Boyan Kirilov Bahnev

Published: Sep. 24, 1998

The invention relates to a cam engine having specific cam curve, where each working profile of the cam (4) is performed with undulating configuration to insure the function for movement of the followers (5) continuous until at least its second derivative within one turnover of the cam (4). The engine may include a mechanism to change the compression ratio and mechanism regulating the fuel-air mixture distribution.

While these combustion engines may be suitable for the purposes for which they were designed, they would not be as suitable for the purposes of the present invention, as hereinafter described.

The present invention overcomes the shortcomings of the prior art by introducing a compression ignition rotating engine wherein the use of a separate combustion chamber, cam and differentiated compression and expansion ratios creates a combination of effects.

The combustion chamber has several advantages that improve fuel efficiency due to the use of compression ignition, the thermodynamic process used, and the time delay before expansion. While, spark ignition engines mix the fuel with air before compression are limited to compression ratios no greater than twelve to prevent autoignition, the combustion chamber's use of compression ignition allows for higher compression ratios previously limited to diesel engines. However, unlike diesel engines where the volume changes during combustion, the CIRC engine performs combustion at a constant volume further increasing the thermal efficiency. Because the combustion is a steady flow process, there is no need for specific fuels to be used. Spark ignition engines require a high-octane fuel to prevent knocking while diesel engines require a lower octane fuel to achieve low cutoff ratios. The CIRC engine is able to burn any fuel with the added benefit of not requiring an ignition system.

The CIRC engine avoids the inherent problem of pistons advancing before complete combustion associated with other reciprocating engines. This causes a loss in efficiency due to potential work being lost and less complete combustion from the rapid drop in pressure and temperature and is speed sensitive. The use of a combustion chamber in the CIRC engine allows for a more complete combustion of the fuel given the longer combustion time at steadier temperatures and pressures. Another inherent problem with other reciprocating engines is the residual combustion gases left over in the cylinder from the clearance volume after the exhaust stroke. These residual gases are then present during intake, compression and combustion of the next cycle. The combustion chamber eliminates the residual gas problem since there is no required clearance volume for the cylinders or need for valves.

The CIRC engine's use of a cam system rather then a crankshaft system completely redefines the torque characteristics of engines. In a crankshaft system, the force component contributing to the torque is a function of the stroke, rod length, and crank angle. When the crank is near top dead center or bottom dead center the force vector contributing to torque is very low. This means the torque required at the last part of the compression stroke is higher than the torque supplied by the end of the power stroke. This causes the torque in the crankshaft to fluctuate between positive and negative torque requiring the use of a flywheel and introducing large vibrations. In contrast, the force component contributing to the torque of the cam system is a function of the gradient of the cam track. Though the cam track geometry is limited by the stroke and radius of rotation, the slope can be varied over the length of the stroke to smooth out the torque. The cam geometry can be adjusted so the end of the compression stroke requires less torque with a shallower cam slope while increasing the torque supplied at the end of the power stroke with a steeper cam slope. This results in the torque always remaining positive and reducing vibration. Vibration is also reduced from the forces being inline with each other. With the end of the power stroke still significantly contributing to the torque, allowing the combustion gases to expand further than the original volume helps convert the left over energy that would normally be exhausted.

SUMMARY OF THE PRESENT INVENTION

A primary object of the present invention is to provide compression ignition rotating cylinder engine that can use a plurality of fuel types without requiring an ignition system.

Another object of the present invention is to provide a compression ignition rotating cylinder having a high fuel efficiency.

Another object of the present invention is to provide a compression ignition rotating cylinder engine having a constant positive torque.

Yet another object of the present invention is to provide a compression ignition rotating cylinder engine having a plurality of opposing reciprocating pistons that travel along cam plates.

Another object of the present invention is to provide a compression ignition rotating cylinder engine wherein air is compressed to a highly volatile state prior to entry into the combustion chamber where fuel is then introduced to promote ignition.

Yet another object of the present invention is to provide a compression ignition rotating cylinder engine that is simple and easy to use.

Still yet another object of the present invention is to provide a compression ignition rotating cylinder engine that is inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
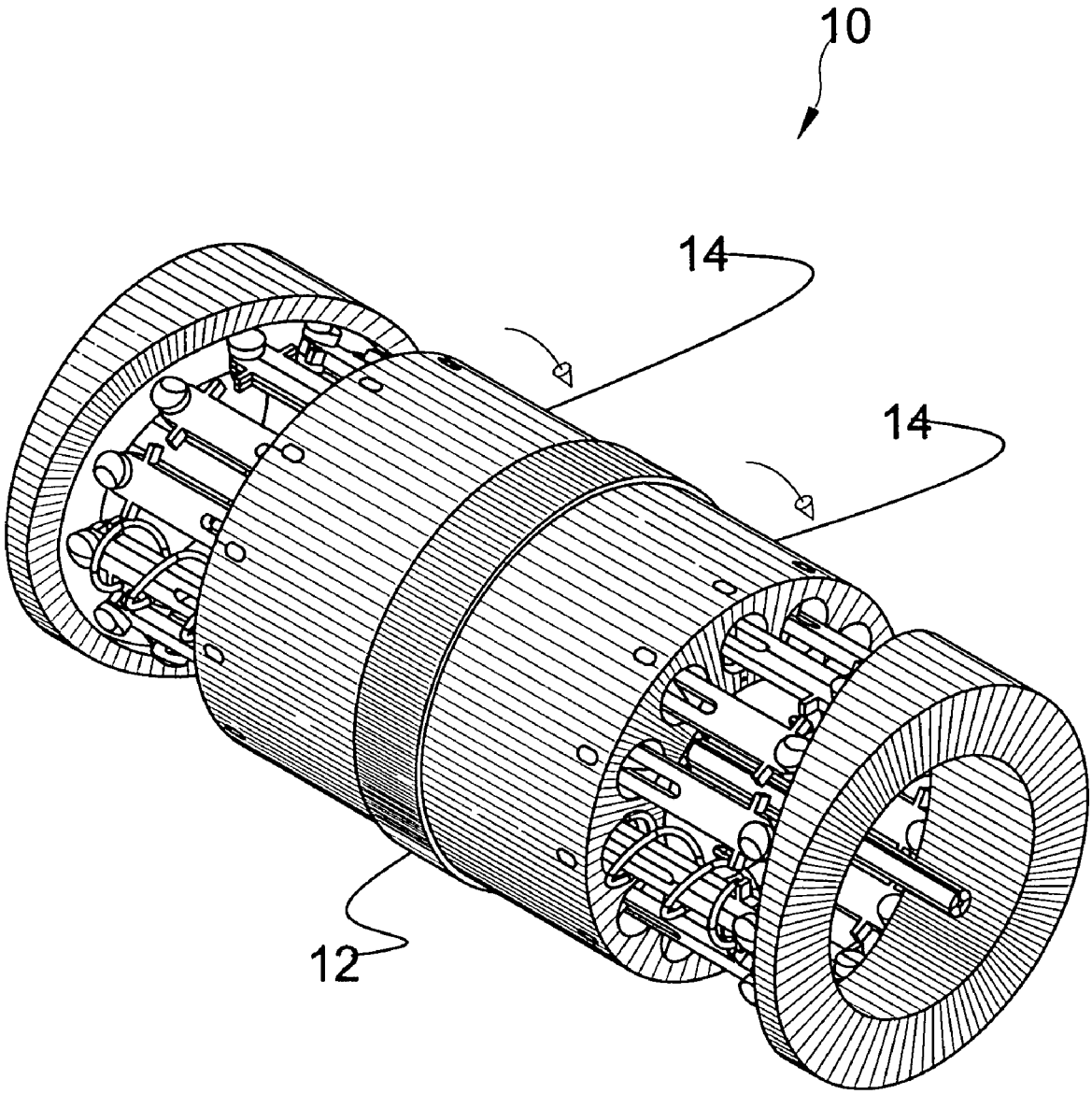
FIG. 1 is an illustrative view of the present invention.

Turning now descriptively to the drawings, in which similar reference characters denote similar elements throughout the several views, the figures illustrate the Compression Ignition Rotating Engine of the present invention. With regard to the reference numerals used, the following numbering is used throughout the various drawing figures.

10 Compression Ignition Rotating Engine
12 header plate
14 cylinder block
16 prior art
18 compression cam plate
20 expansion cam plate
21 intake port
22 intake channel
24 exhaust port
25 exhaust channel
26 piston assembly
28 piston head
30 piston rod
31 slider pin
32 spring
33 set pin
34 cam follower
36 compression piston
38 expansion piston
40 combustion chamber
42 fuel injector
44 drive shaft
46 oil passages
48 splines of 44
50 swing arm
51 swing arm support
52 counter weight
54 tension spring
56 push arm

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention, a compression ignition rotating cylinder engine (CIRC), provides a design that has several distinct advantages over conventional internal combustion engines. Rotating cylinder blocks 14 and a fixed header plate 12 provide a more fuel-efficient engine with constant positive torque and reduced vibration.

Figure 2:
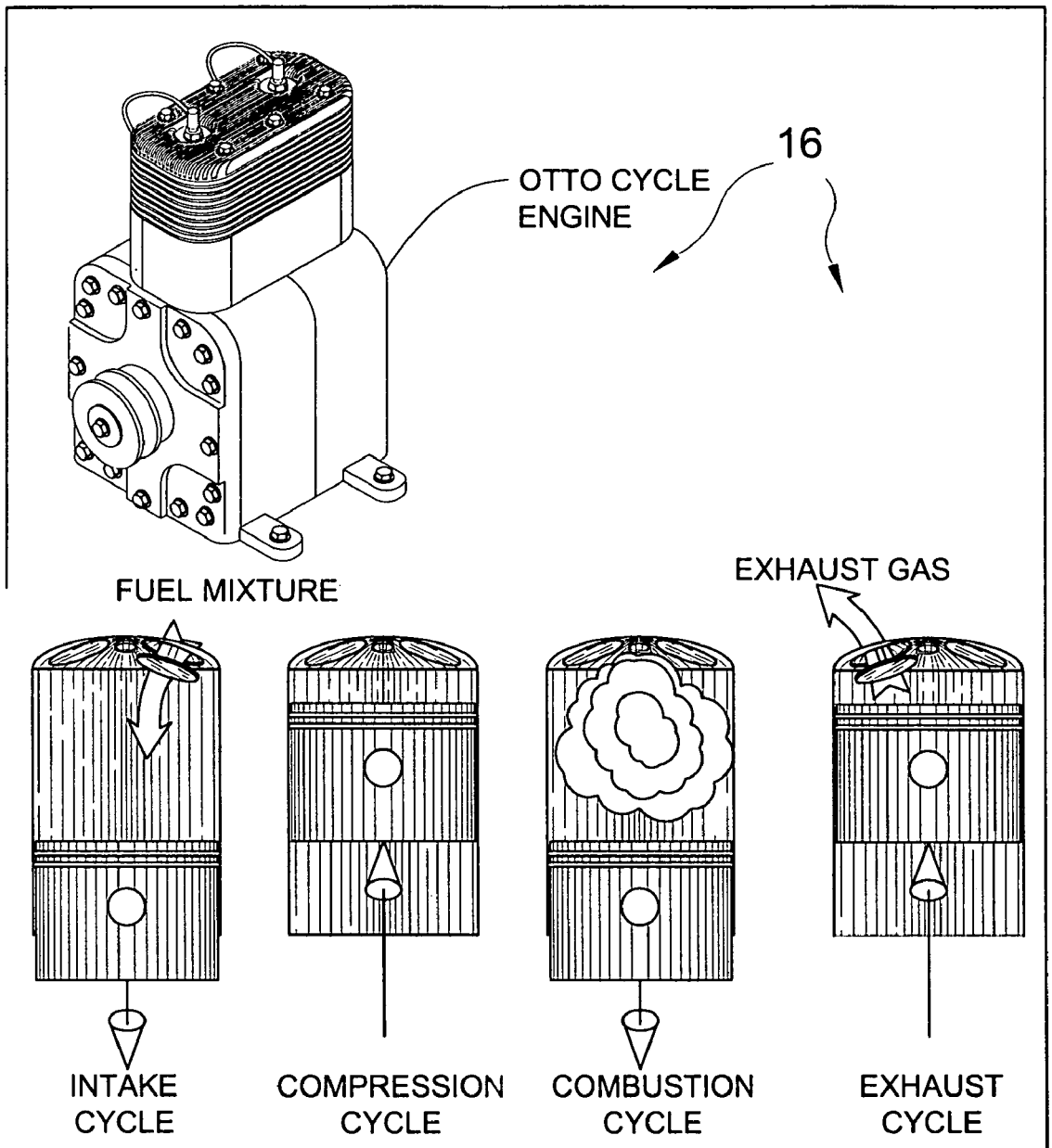
FIG. 2 is an illustrative view of the prior art.

FIG. 2 is an illustrative view of the prior art 16; FIG. 2 illustrates the basic Otto cycle, which is used in the typical internal combustion engine. The present invention, the CIRC engine uses a four-stroke cycle but accomplishes it in a very different and unique way. The following illustrations, FIGS. 3–6 will compare and contrast the four cycles of the present invention and prior art.

Figure 3:
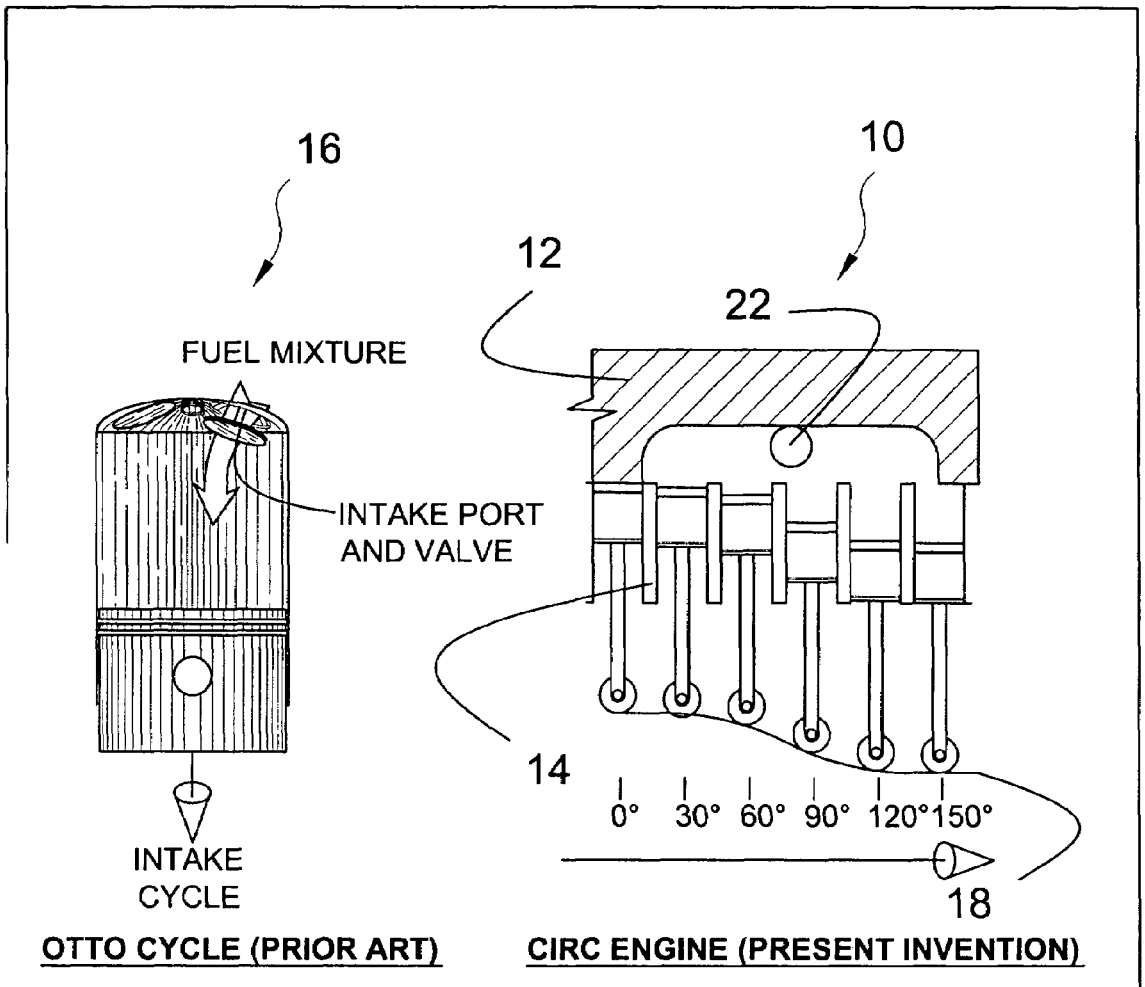
FIG. 3 is an illustrative view of the intake cycle of the present invention.

FIG. 3 is an illustrative view of the intake cycle of the present invention 10. FIG. 3 illustrates a comparison between the Otto cycle engine and the present invention 10. Prior art 16 provides a design using an intake port and valve to control when the fuel mixture fills the piston cylinder. A carburetor or fuel injector controls the ratio of fuel and air. The intake cycle of the CIRC engine only draws air into the cylinder as the piston block 12 rotates past the intake channel 22. The piston draws air into the cylinders as it is pushed down against the cam track 14 by a spring (see FIG. 8).

Figure 4:
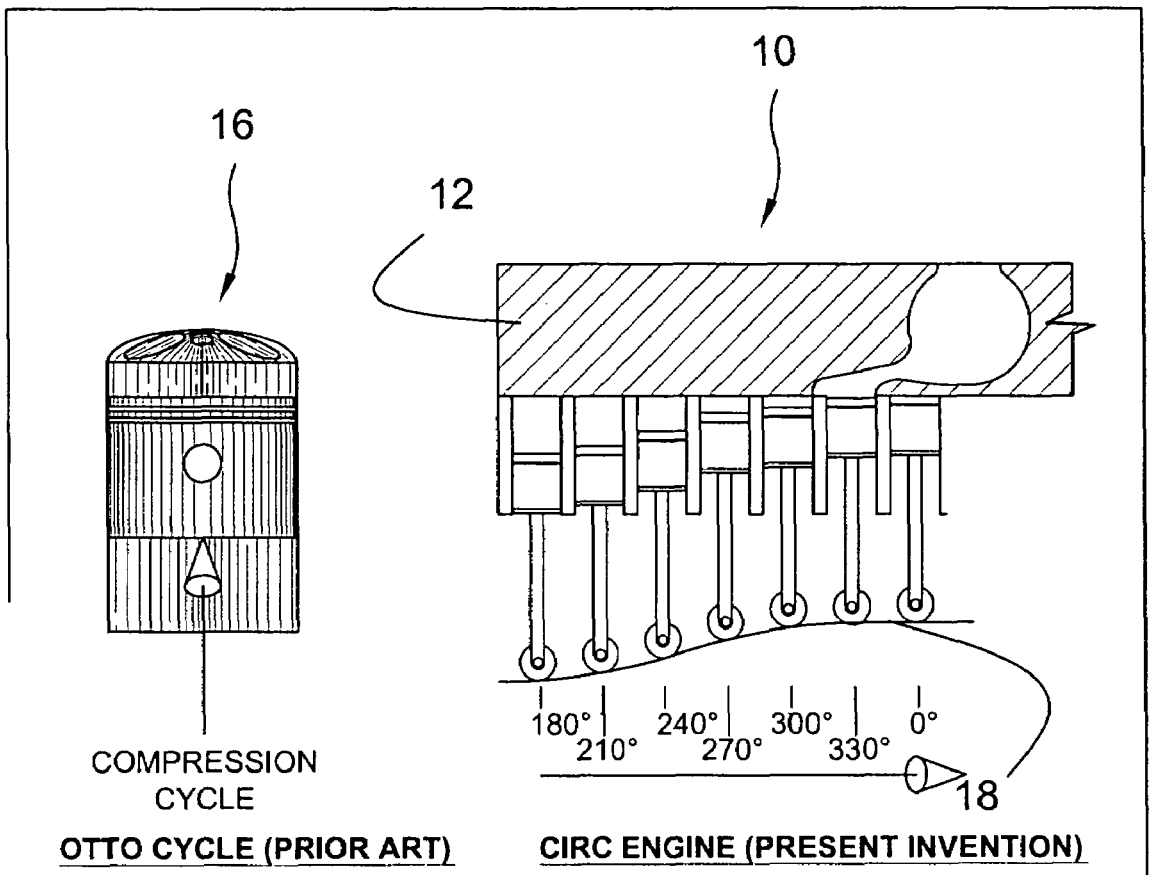
FIG. 4 is an illustrative view of the compression cycle of the present invention.

FIG. 4 is an illustrative view of the compression cycle of the present invention 10. FIG. 4 illustrates a comparison between the Otto cycle engine and the present invention 10. Prior art 16 provides a design where the piston compresses the fuel-air mixture in the cylinder; both the intake and exhaust port valves are closed. The air in the cylinders of the CIRC engine is compressed as the pistons rise along the cam plate 18 and compresses the air against the header plate 12.

Figure 5:
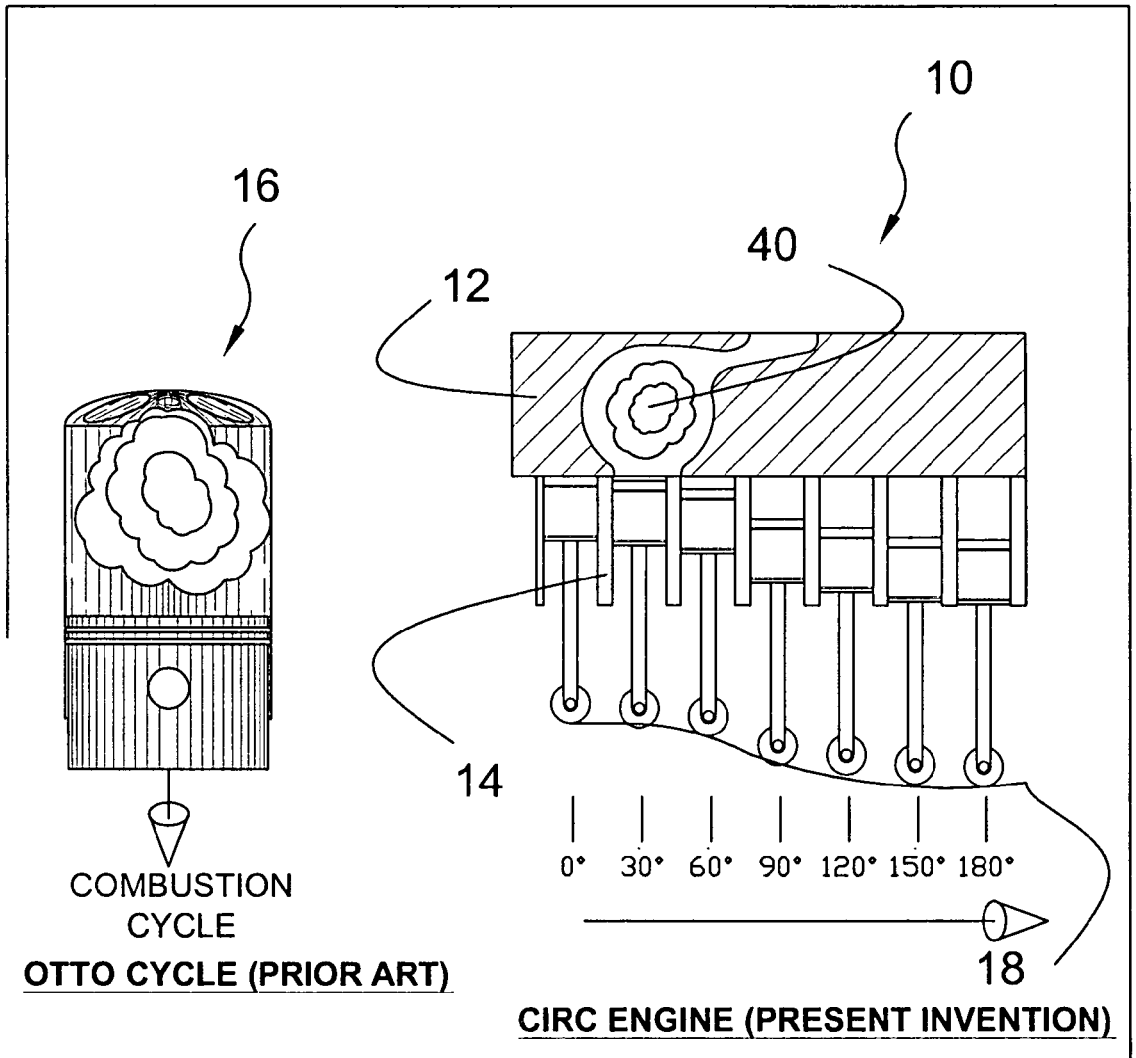
FIG. 5 is an illustrative view of the combustion or expansion cycle of the present invention.

FIG. 5 is an illustrative view of the combustion and expansion cycle of the present invention 10. FIG. 5 illustrates a comparison between the Otto cycle engine and the present invention 10. Combustion in prior art 16 occurs in the piston cylinder at a preset crankshaft angle and ignition timing. The expanding gases send the piston back down the cylinder. The combustion in the CIRC engine occurs in the combustion chamber 40 not in the cylinders. The compressed air travels through the intake port into the combustion chamber 40 where fuel is introduced by a fuel injector. The high temperature of the compressed air ignites the fuel-air mixture. The combustion gases then pass through the exhaust port into a cylinder in the opposed cylinder block. Expanding exhaust gases force the piston down along the cam plate.

Figure 6:
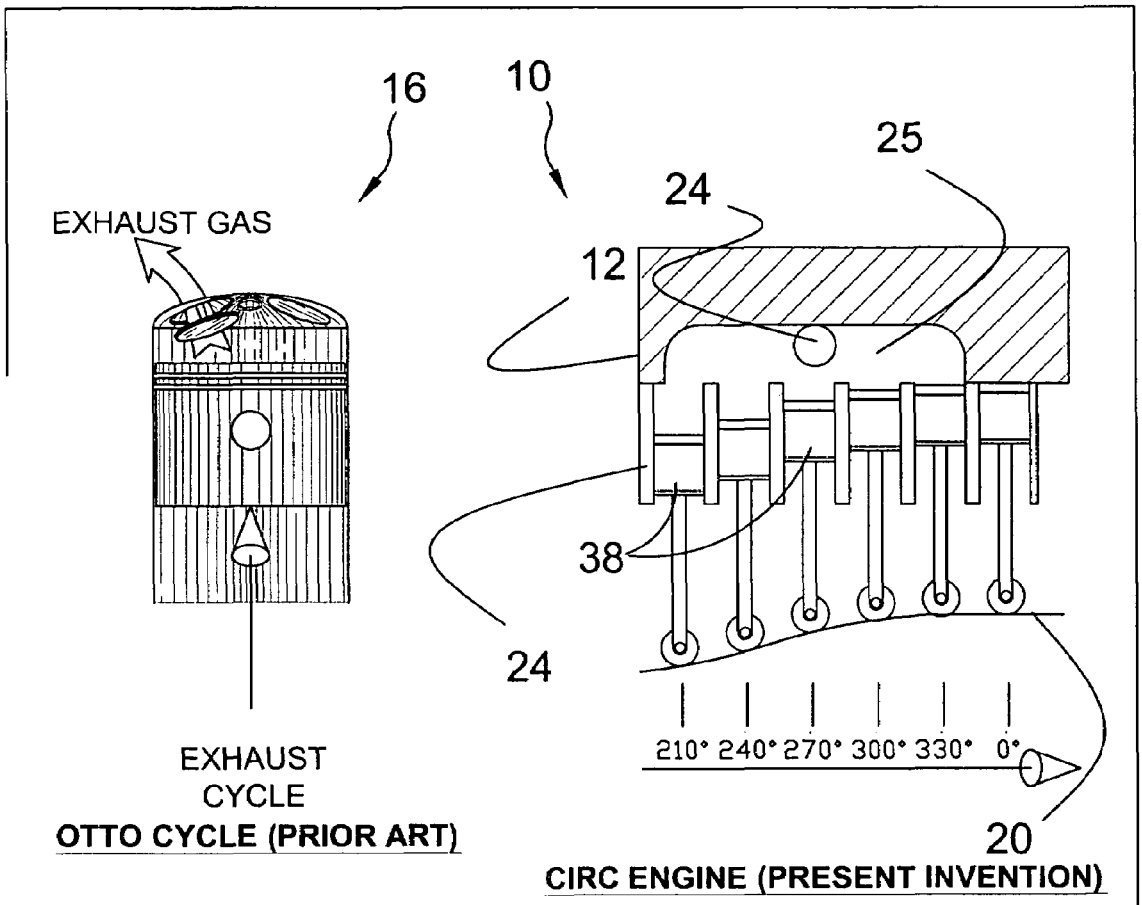
FIG. 6 is an illustrative view of the exhaust cycle of the present invention.

FIG. 6 is an illustrative view of the exhaust cycle of the present invention 10. FIG. 6 illustrates a comparison between the Otto cycle engine and the present invention 10. Prior art 16 provides a design where the exhaust gases are forced out through an exhaust port 24 as the expansion piston 38 rises in the cylinder and the exhaust port 24 valve opens. The exhaust gases in the cylinders of the CIRC engine are expelled out of the cylinders as the cylinders rotate passed the exhaust channel 25 in the header plate 12. The gases are forced out by the expansion pistons 38 as they rise along the slope of the expansion cam plate 20.

Figure 7:
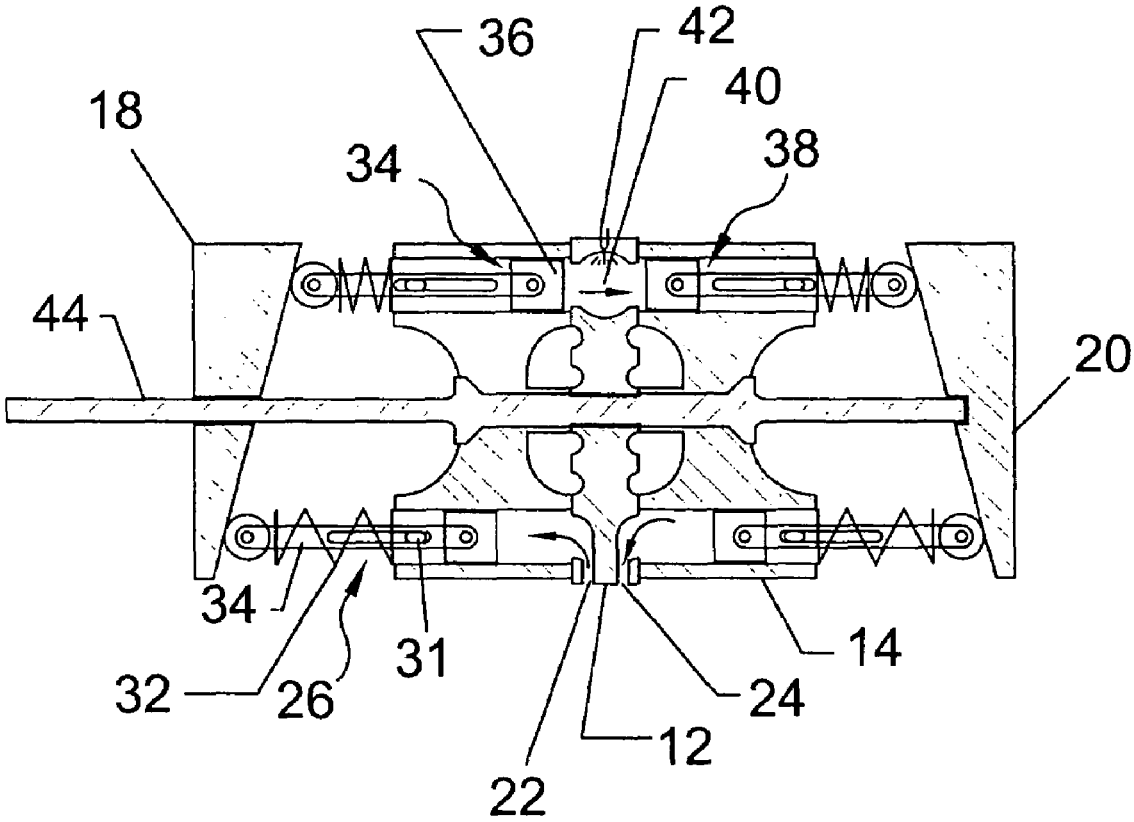
FIG. 7 is a mechanical schematic of the present invention.

FIG. 7 is a mechanical schematic of the present invention 10. FIG. 7 provides a mechanical schematic showing the major components of the present invention 10.

Figure 8:
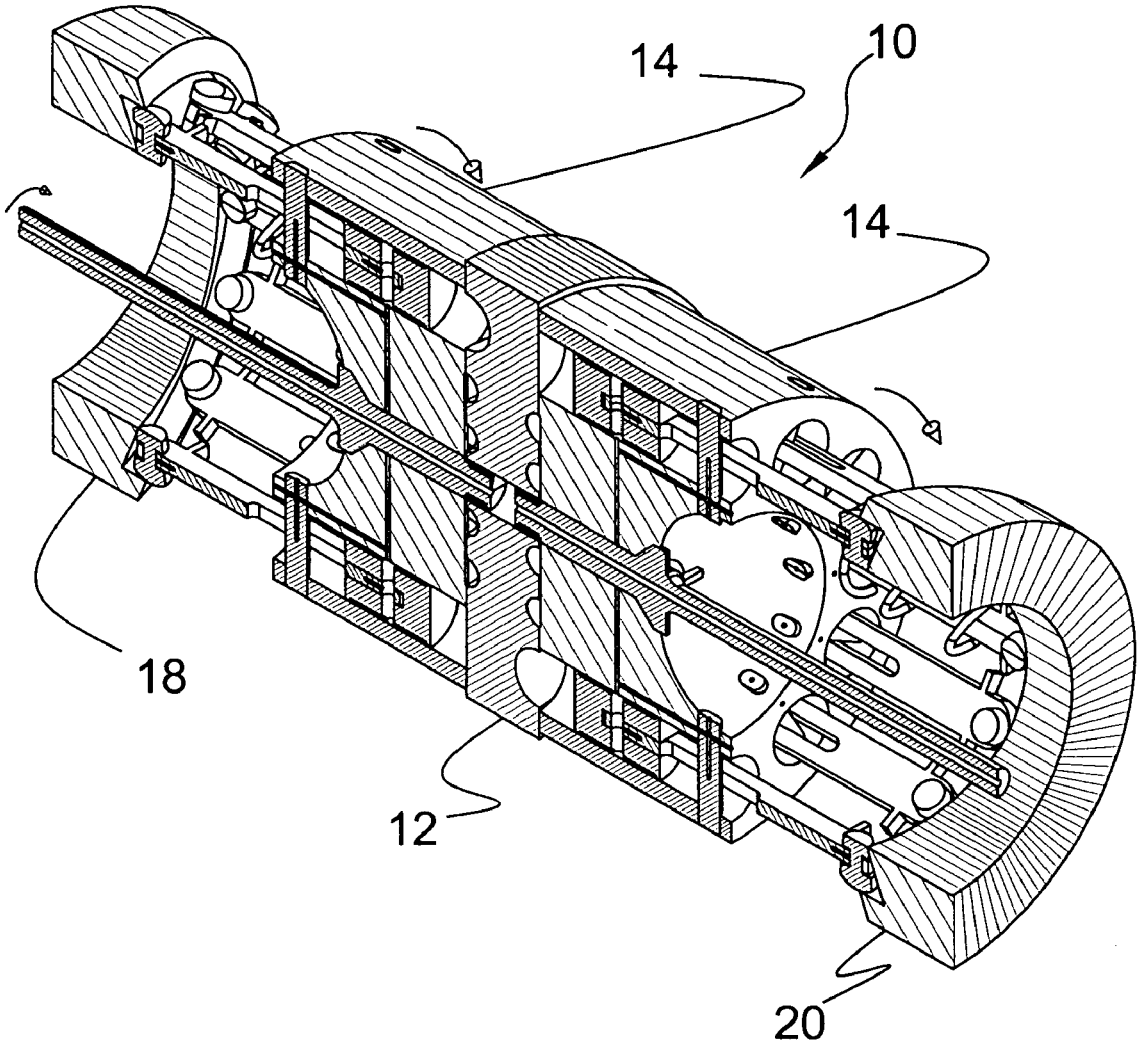
FIG. 8 is an isometric cross section of the present invention.

FIG. 8 is an isometric cross section of the present invention 10. One of the unique features of the CIRC engine is the opposing cylinder blocks 14. Unlike prior art where all of the engine cycles are performed in every cylinder the CIRC engine provides a radial type configuration of cylinders in two opposing cylinder blocks 14. One block of cylinders performs the intake and compression of air as they travel along the compression cam plate 18. The opposing block performs the power stroke and exhaust after combustion in the combustion chamber.

Figure 9:
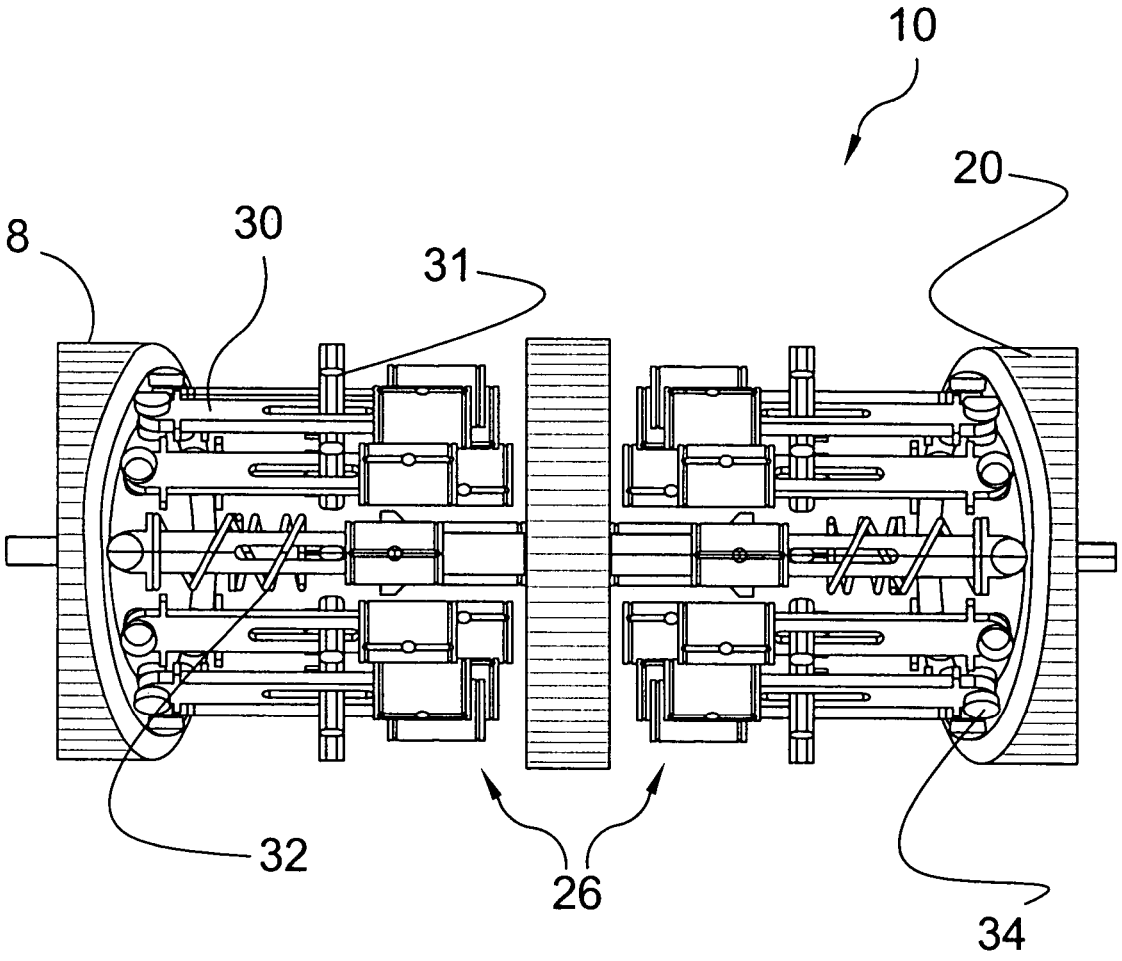
FIG. 9 is an illustrative plan view of the piston assemblies.

FIG. 9 is an illustrative plan view of the piston assemblies 26. The piston assemblies 26 are of a radial configuration in the cylinder blocks 14. Slider pins 31 provide a linear bearing surface to constrain the piston assemblies 26 to cylinder block 14. Compression springs 32 preload the piston rods 30 and maintain the contact of the cam follower bearings 34 and the cam plates 18,20.

Figure 10:
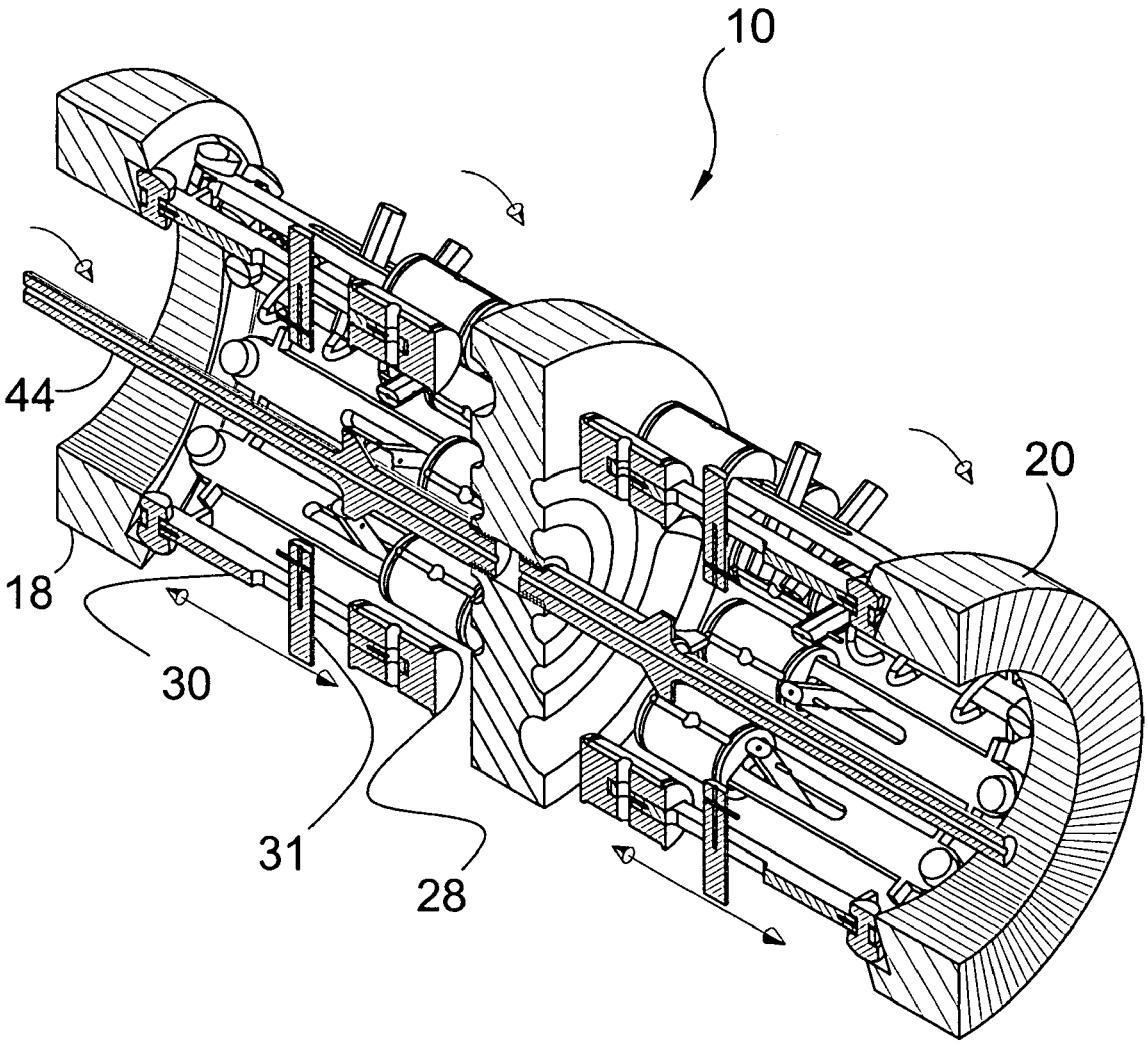
FIG. 10 is an isometric cross section of the piston assemblies.

FIG. 10 is an isometric cross section of the piston assemblies 26. The piston assemblies 26 rotate with the cylinder blocks about the axis of the drive shaft 44. The rotation of the cylinder blocks along with the linear motion of the piston assemblies 26 along the cam plates 18,20 provide the mechanical timing of the CIRC engine 10.

Figure 11:
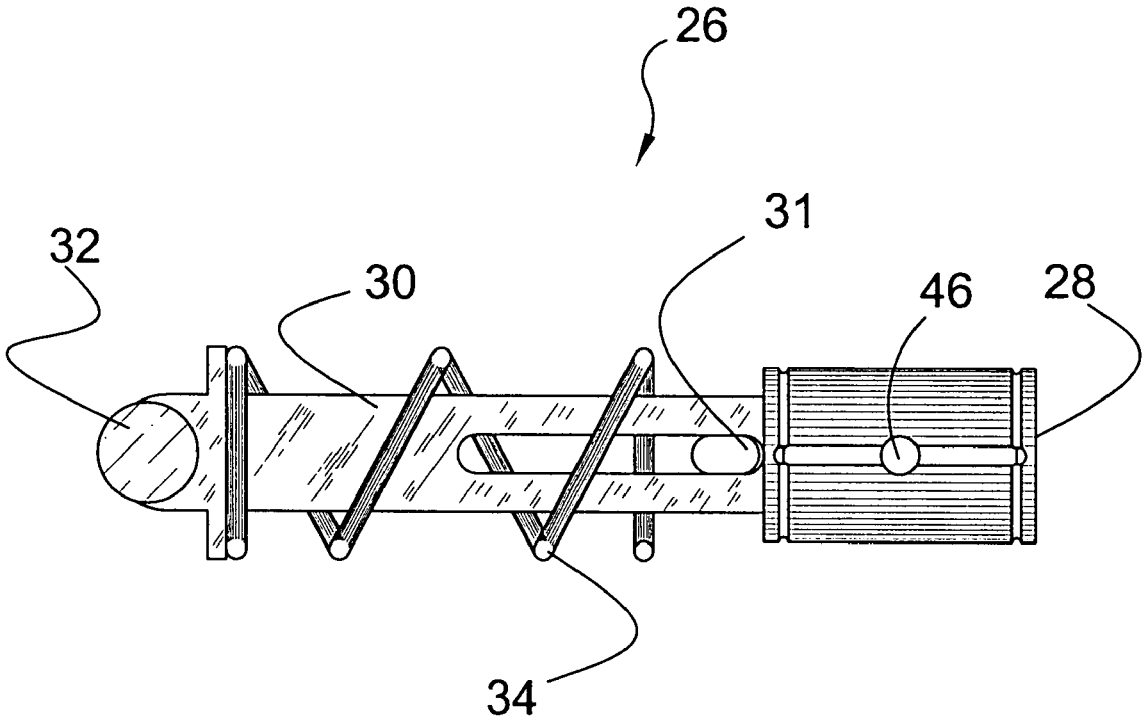
FIG. 11 is a plan view of a piston assembly.

FIG. 11 is a plan view of a piston assembly 26. The piston assemblies 26 are comprised of four (4) major components. The piston head 28 and piston rod 30 function much like the components of a conventional engine. The cam follower 34 and spring 32 provide the linear motion of the assembly along the cam plate.

Figure 12:
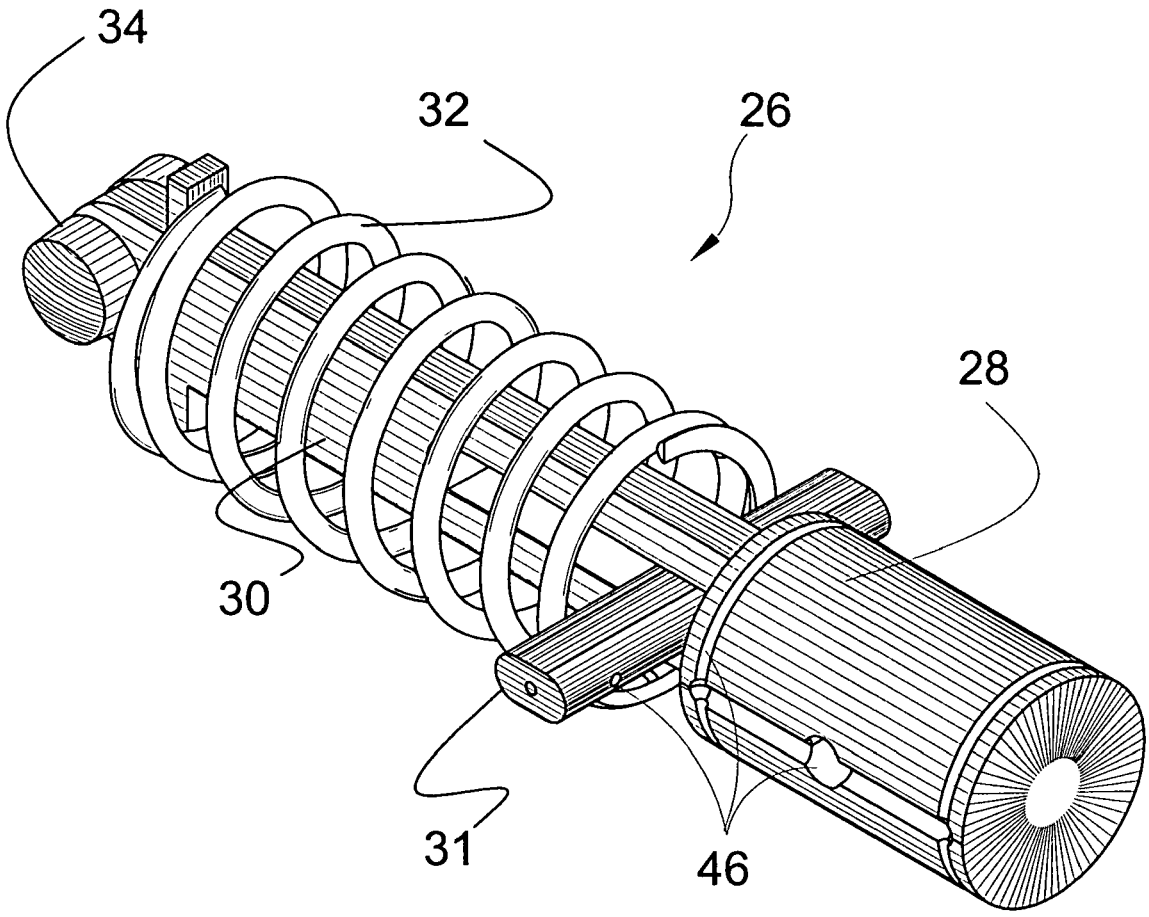
FIG. 12 is an isometric view of a piston assembly.

FIG. 12 is an isometric view of a piston assembly. The piston assemblies are lubricated from the engine block oil channels 46 running through the slider pin 31, piston rod 30 and piston 28.

Figure 13:
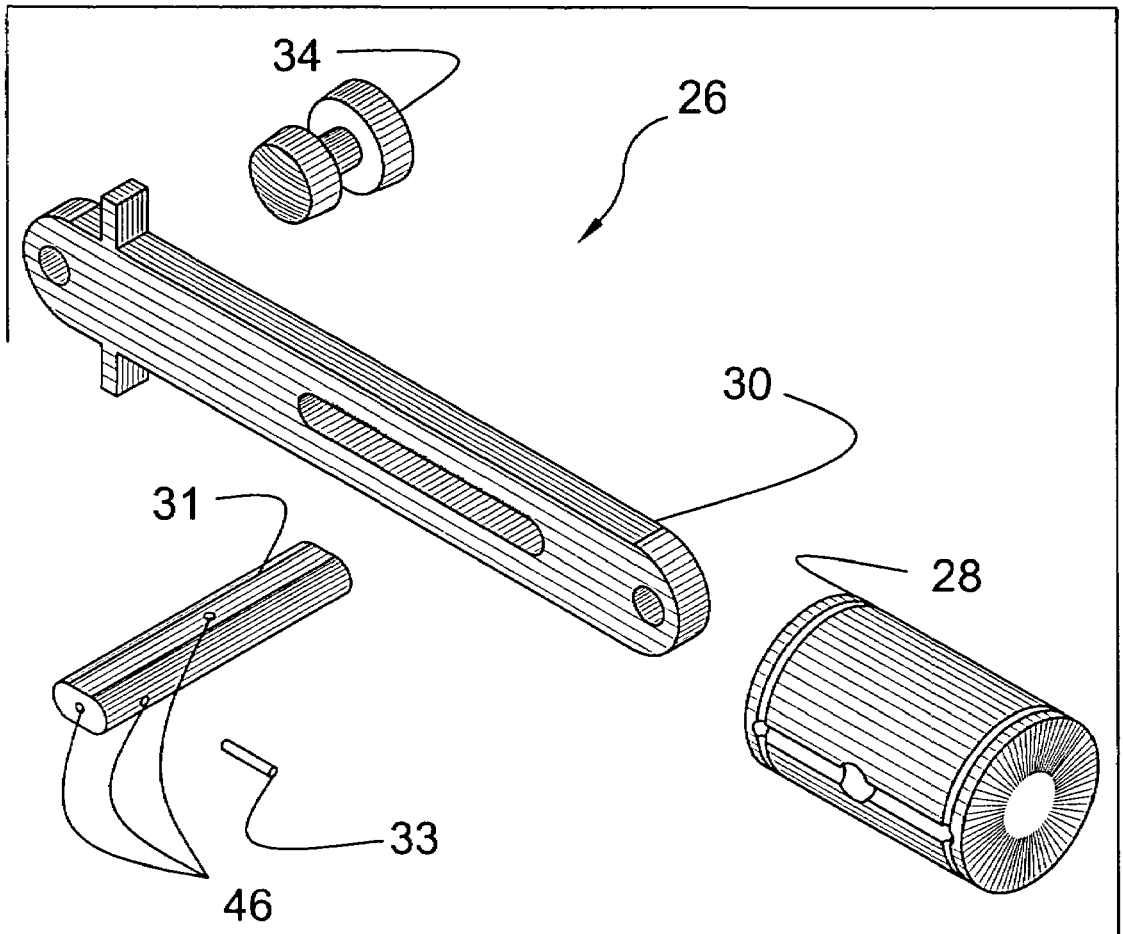
FIG. 13 is an exploded isometric view of a piston assembly.

FIG. 13 is an exploded isometric view of a piston assembly 26. The slider pin 31 is located and constrained to the cylinder block by a set pin. The oil passages in the slider pin 31 provide lubrication to the piston rod 30, cam follower 34 and piston head 30.

Figure 14:
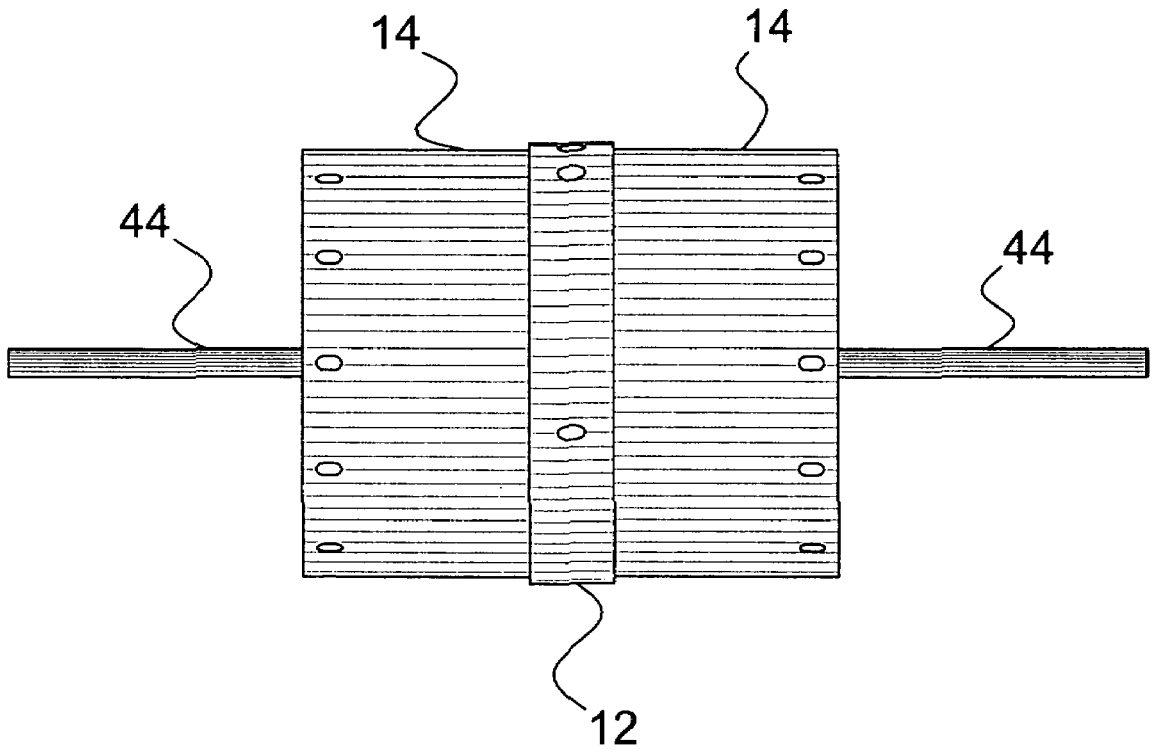
FIG. 14 is a partial plan view of the present invention.

FIG. 14 is a partial plan view of the present invention. The cylinder blocks 14 are constrained to the drive shaft 44 on opposite sides of the header plate 12. The cylinder blocks 14 and drive shaft 44 rotate while the header plate 12 is fixed.

Figure 15:
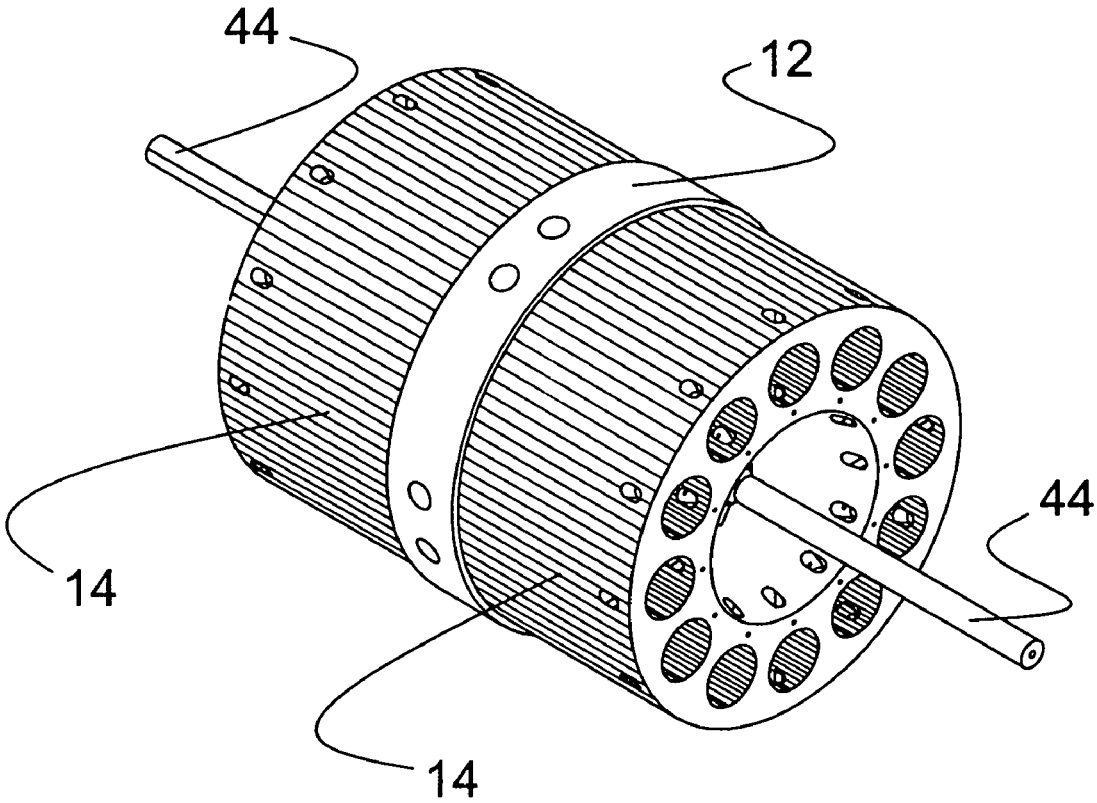
FIG. 15 is an isometric view of a partial assembly of the present invention.

FIG. 15 is an isometric view of a partial assembly of the present invention showing the header plate 12 with a cylinder block 14 on either side with the drive shaft 44 extending therethrough.

Figure 16:
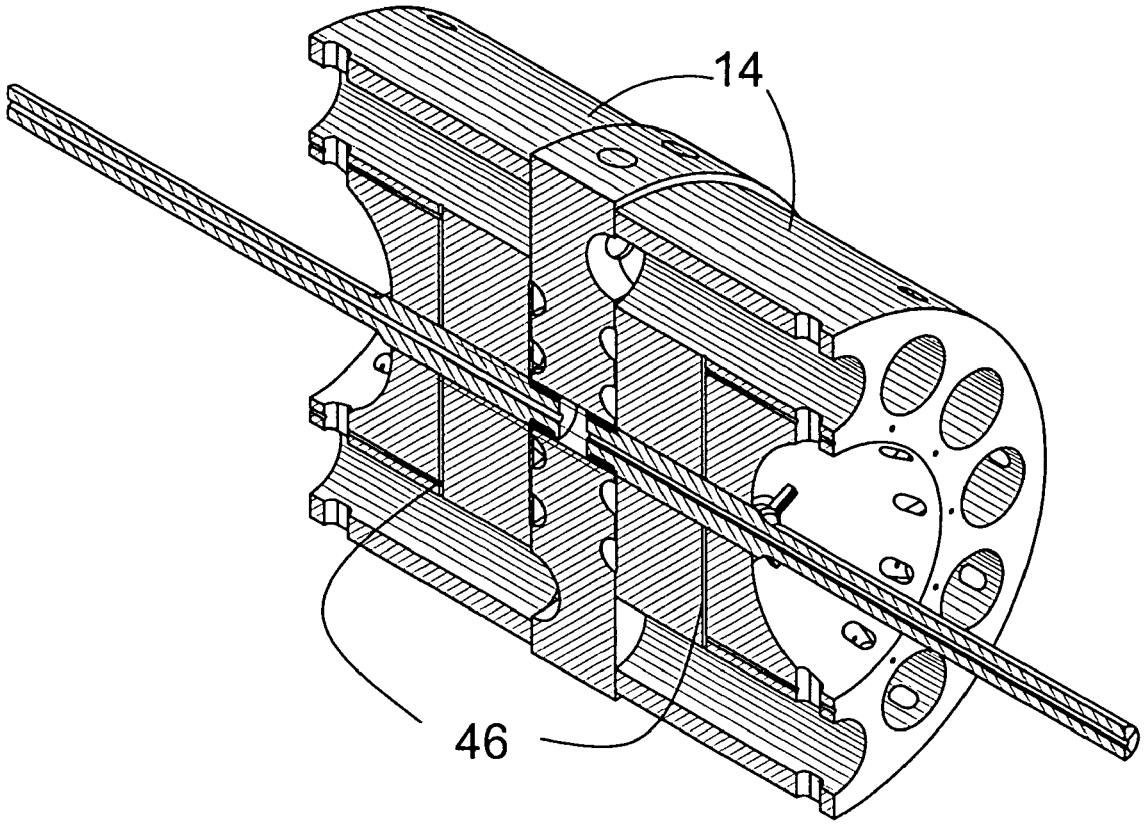
FIG. 16 is a partial cross sectional view of the present invention.

FIG. 16 is a partial cross sectional view of the present invention. Oil passages 46 in the cylinder blocks 14 provide lubrication to the piston assemblies.

Figure 17:
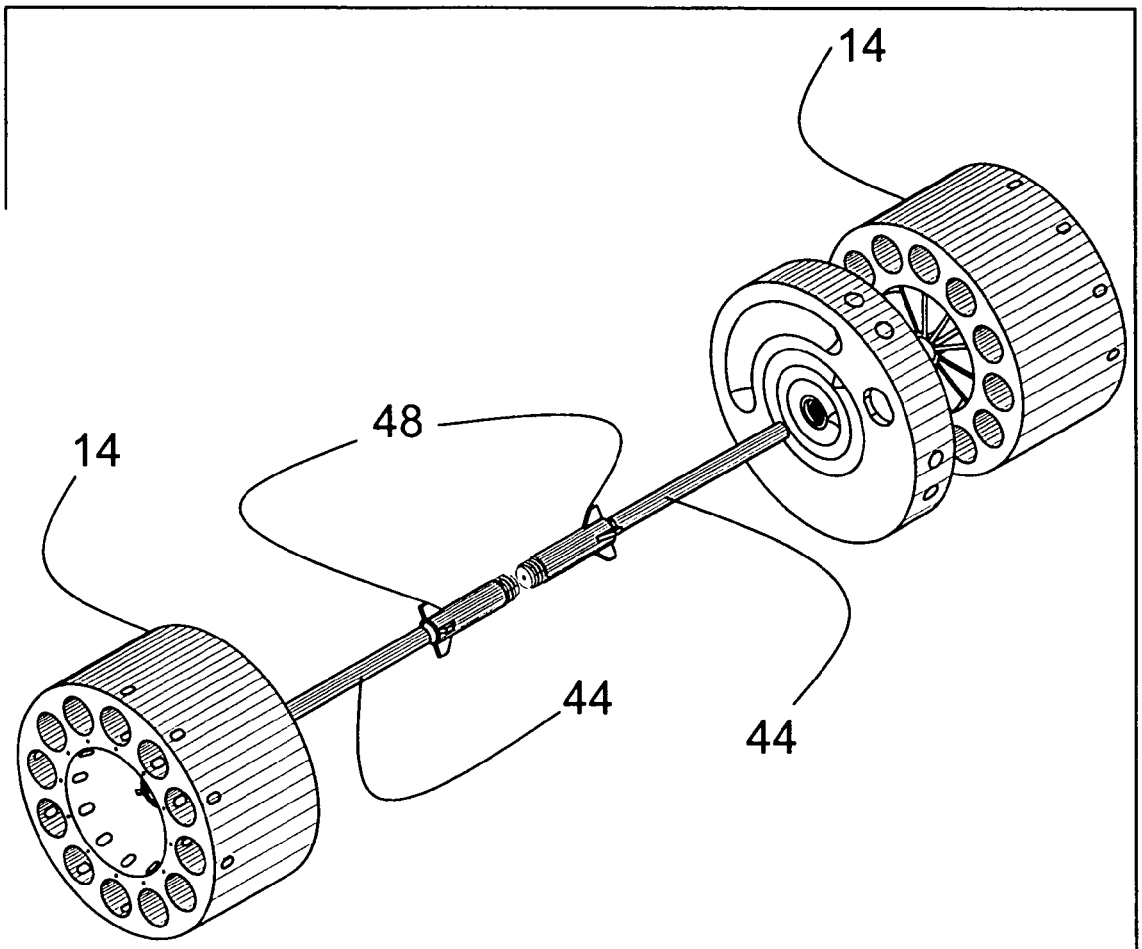
FIG. 17 is a partial isometric view of the present invention.

FIG. 17 is a partial isometric view of the present invention. An array of fin-like splines 48 constrains the drive shafts 44 to the cylinder blocks 14.

Figure 18:
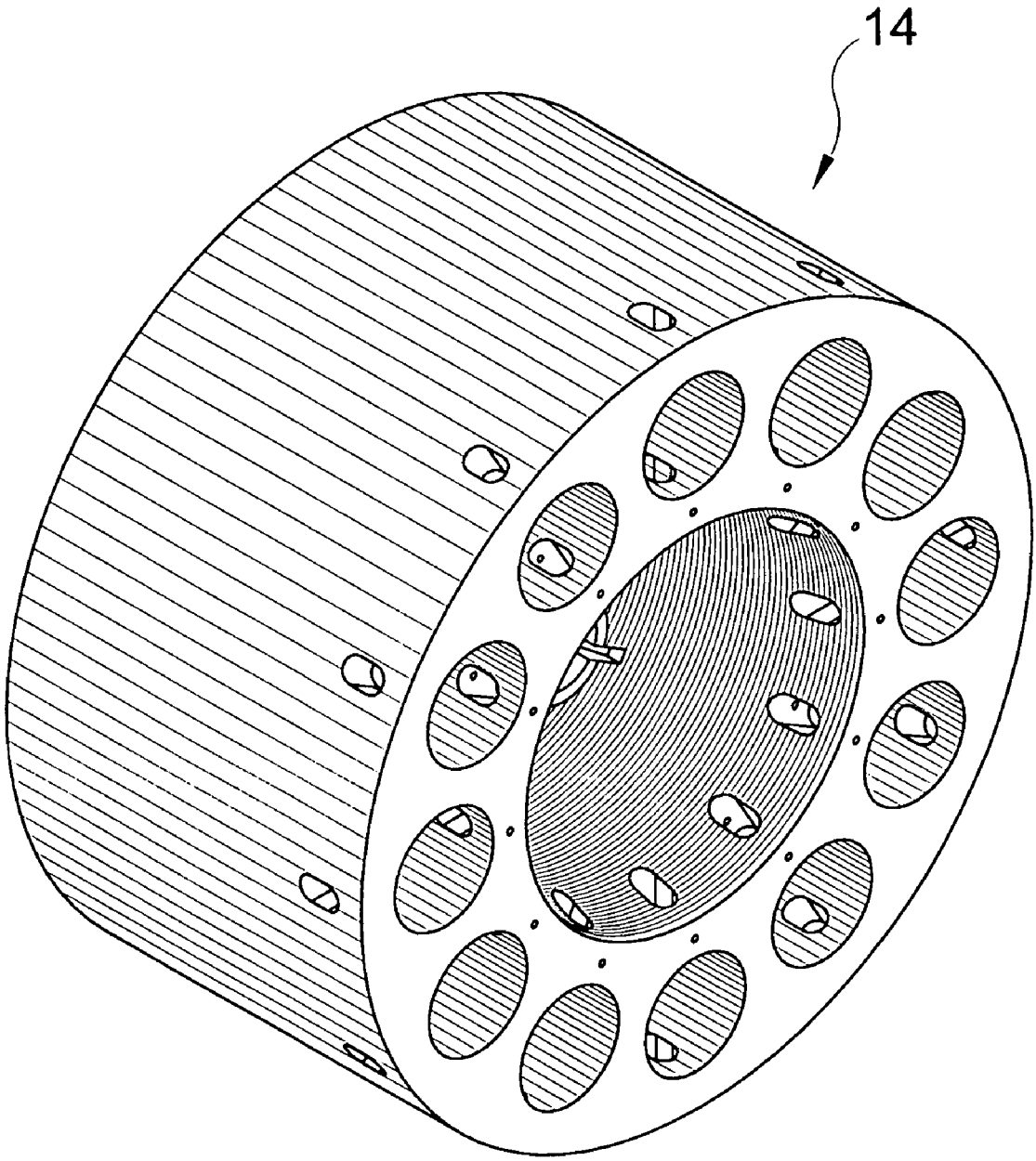
FIG. 18 is an isometric view of a cylinder block.

FIG. 18 is an isometric view of a cylinder block 14.

Figure 19:
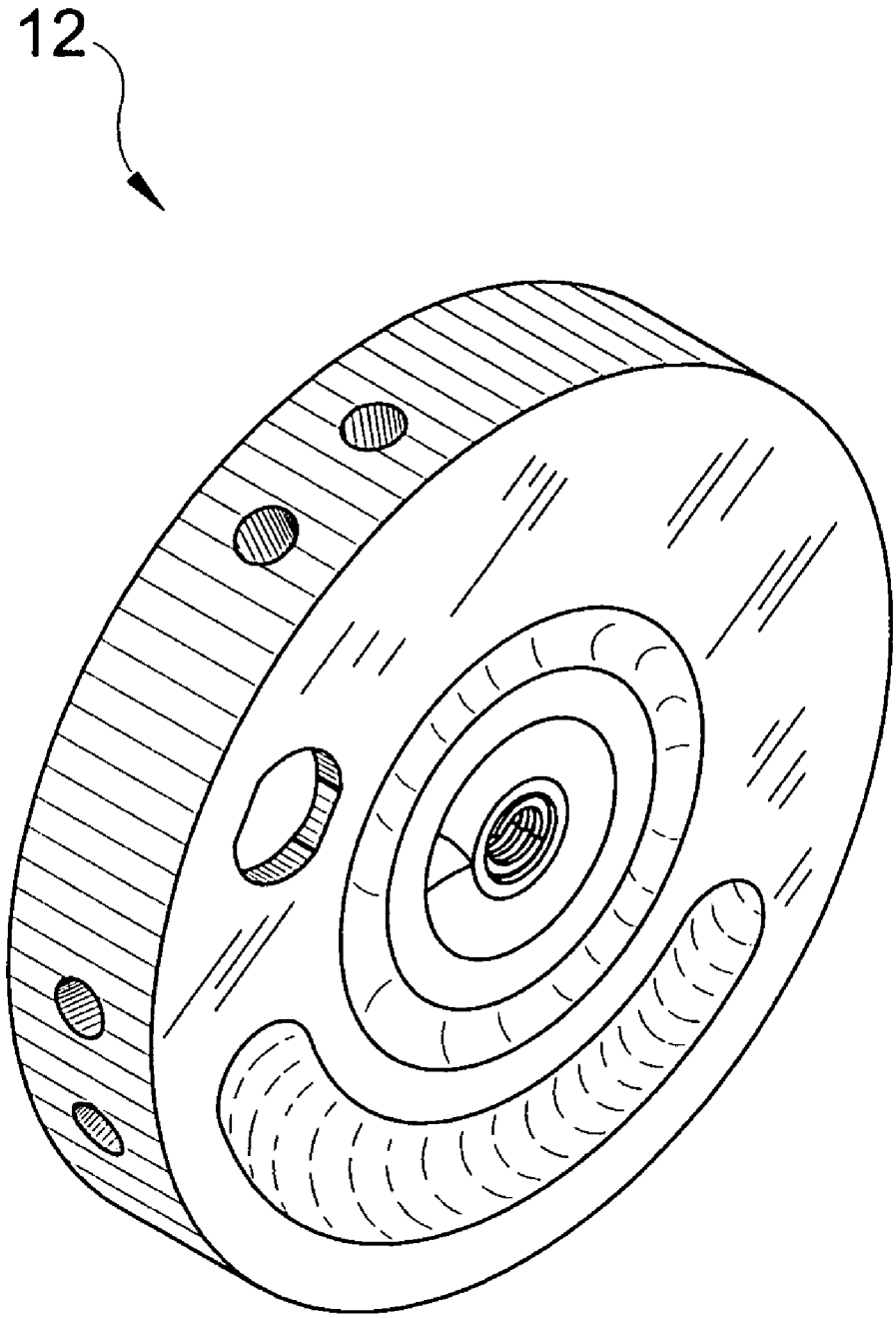
FIG. 19 is an isometric view of the header plate.

FIG. 19 is an isometric view of the header plate 12. The header plate of the CIRC engine provides the same functions as a cylinder head on a conventional internal combustion engine. The header plate includes one or more combustion chambers, combustion air intake and exhaust channels, and cooling air intake and exhaust channels.

Figure 20:
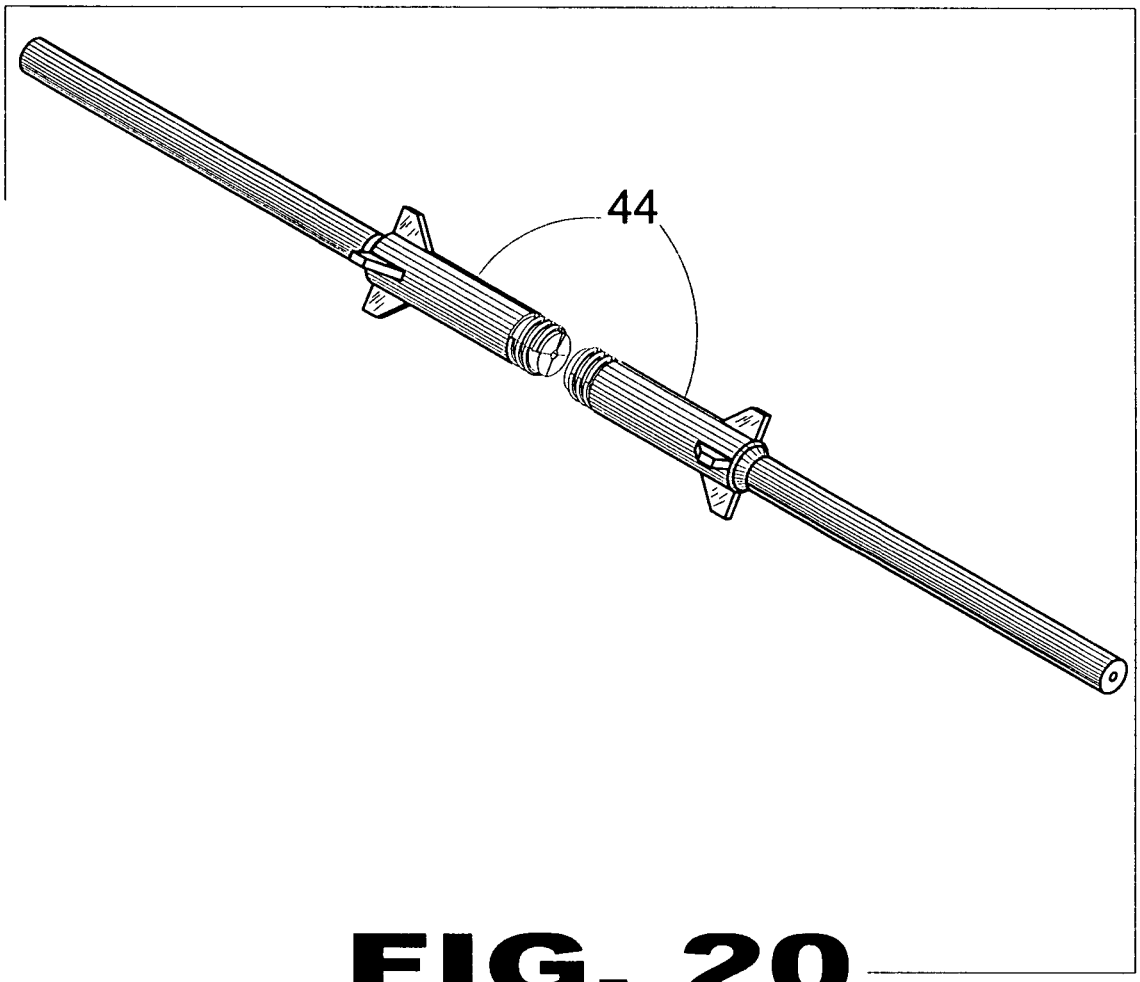
FIG. 20 is an isometric view of the drive shafts.

FIG. 20 is an isometric view of the drive shafts 44.

Figure 21:
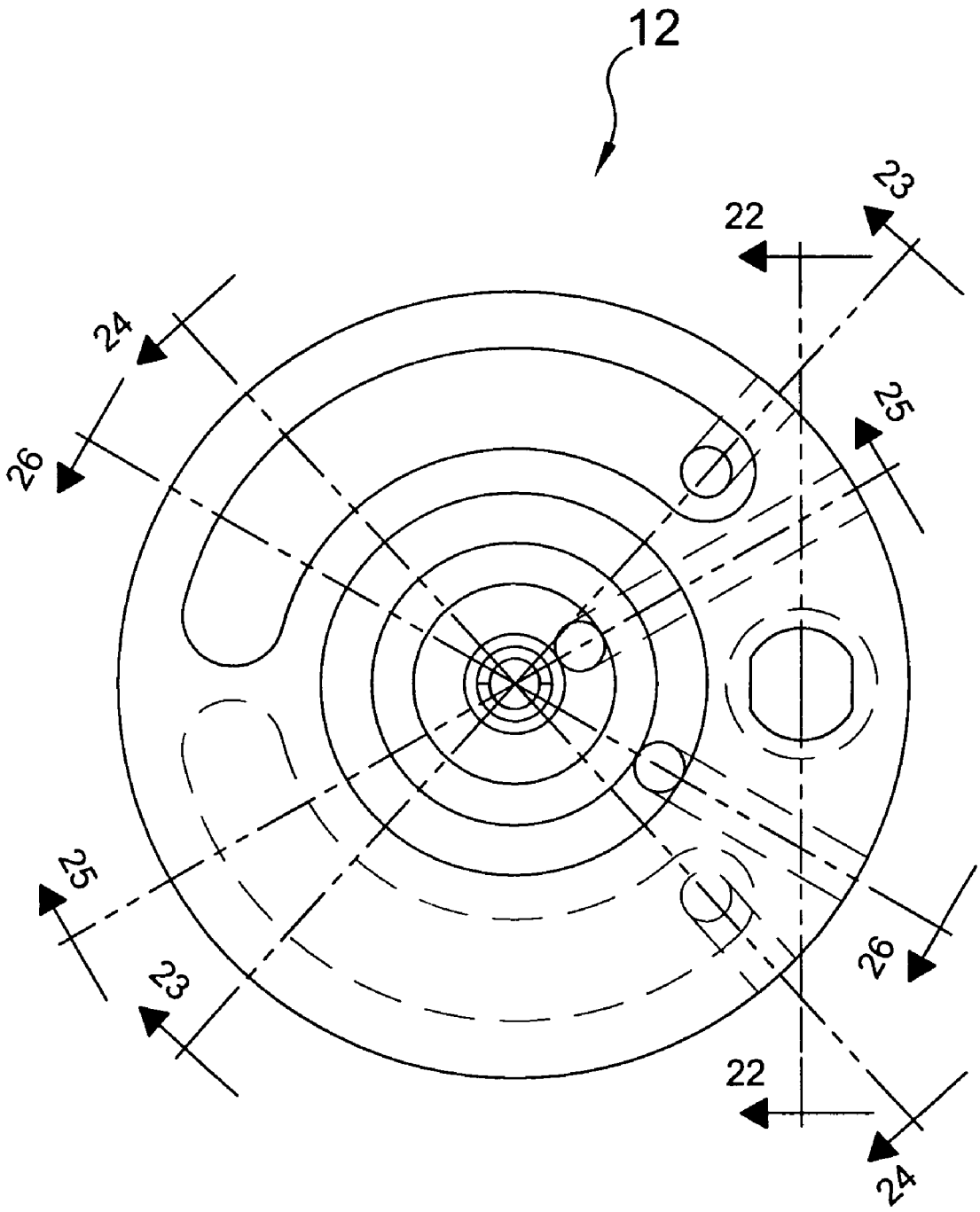
FIG. 21 is a plan view of the header plates.

FIG. 21 is a plan view of the header plate 12. The header plate 12 provides the same function as a cylinder head on a conventional internal combustion engine.

Figure 22:
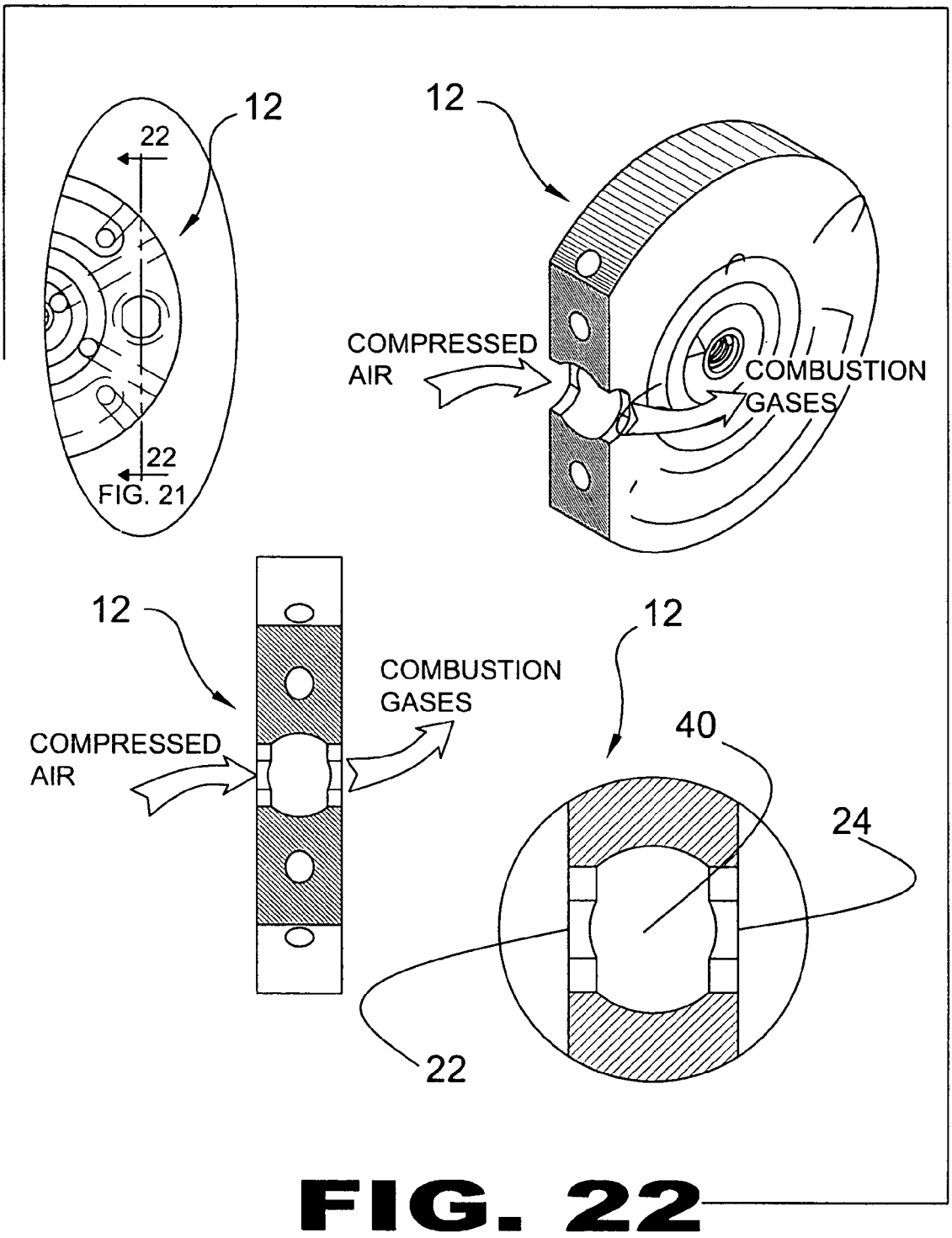
FIG. 22 is a cross sectional view of the header plate combustion chamber.

FIG. 22 is a cross sectional view of the header plate 12 combustion chamber 40 demonstrating the path of the compressed air introduced into the intake port 22 and combustion gases as they combine in the combustion chamber 40 and are expelled through the exhaust port 24.

Figure 23:
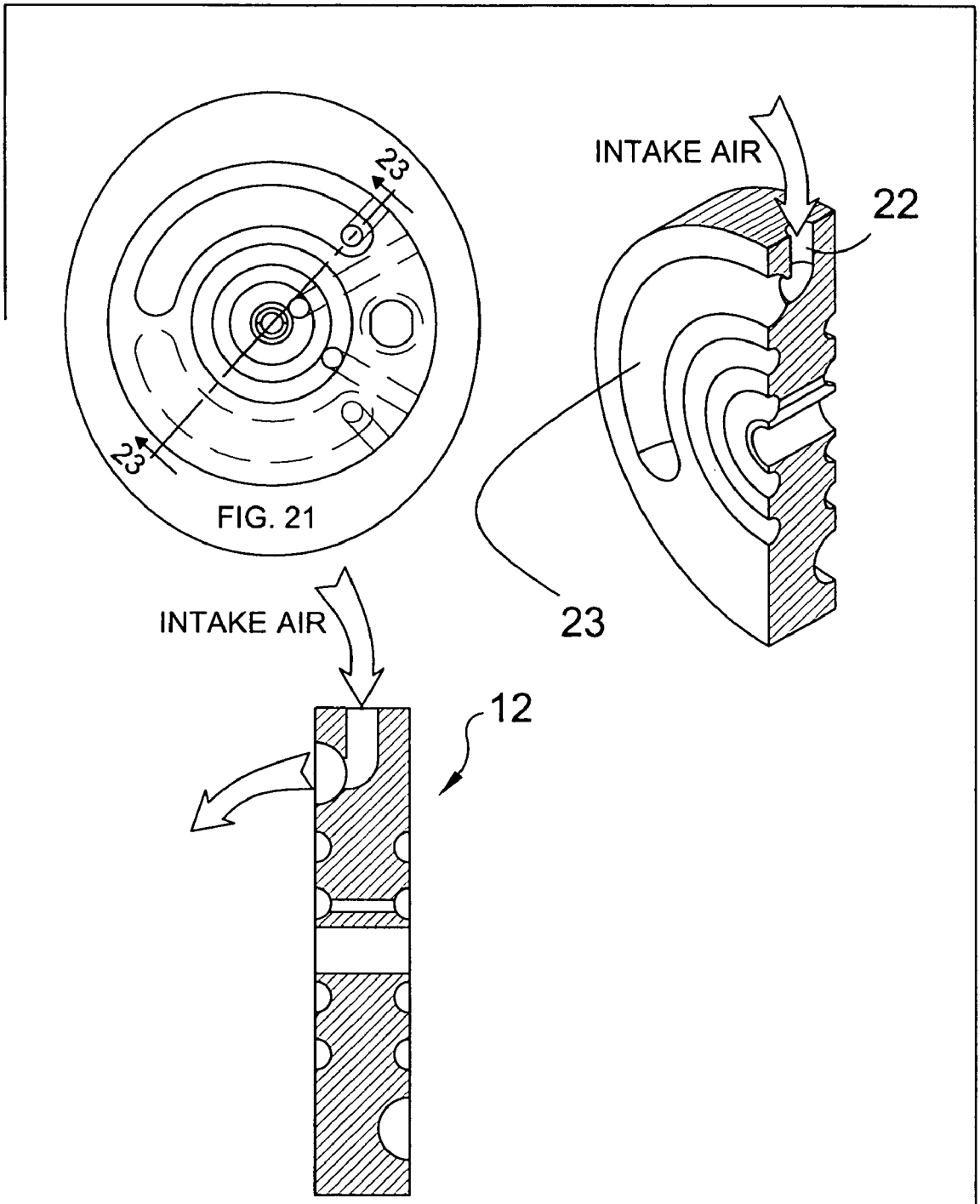
FIG. 23 is a cross sectional view of the header intake port.

FIG. 23 is a cross sectional view of the header intake port 22 showing the path of the compressed air through intake.

Figure 24:
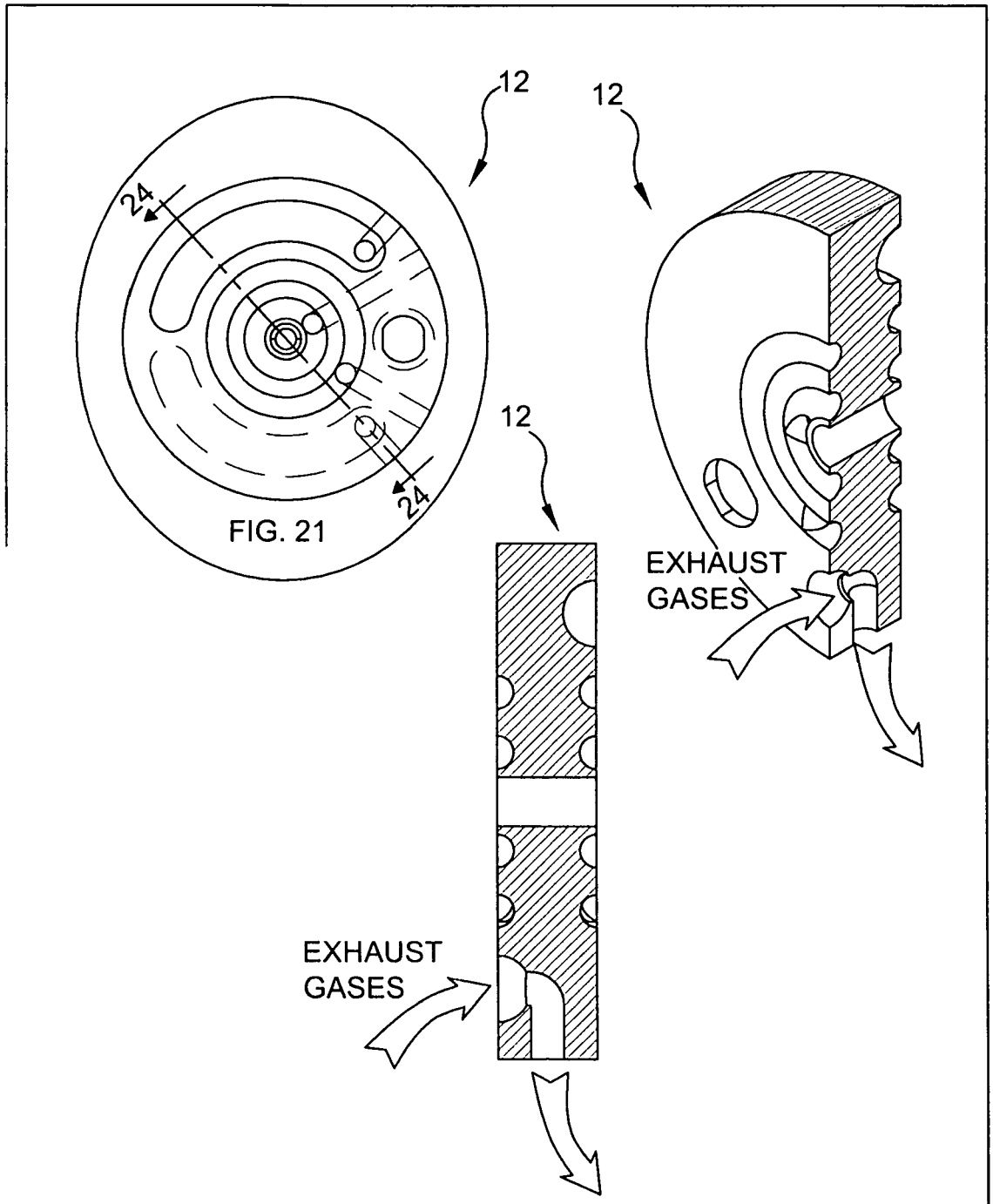
FIG. 24 is a cross sectional view of the header plate exhaust port.

FIG. 24 is a cross sectional view of the header plate 12 exhaust port 24.

Figure 25:
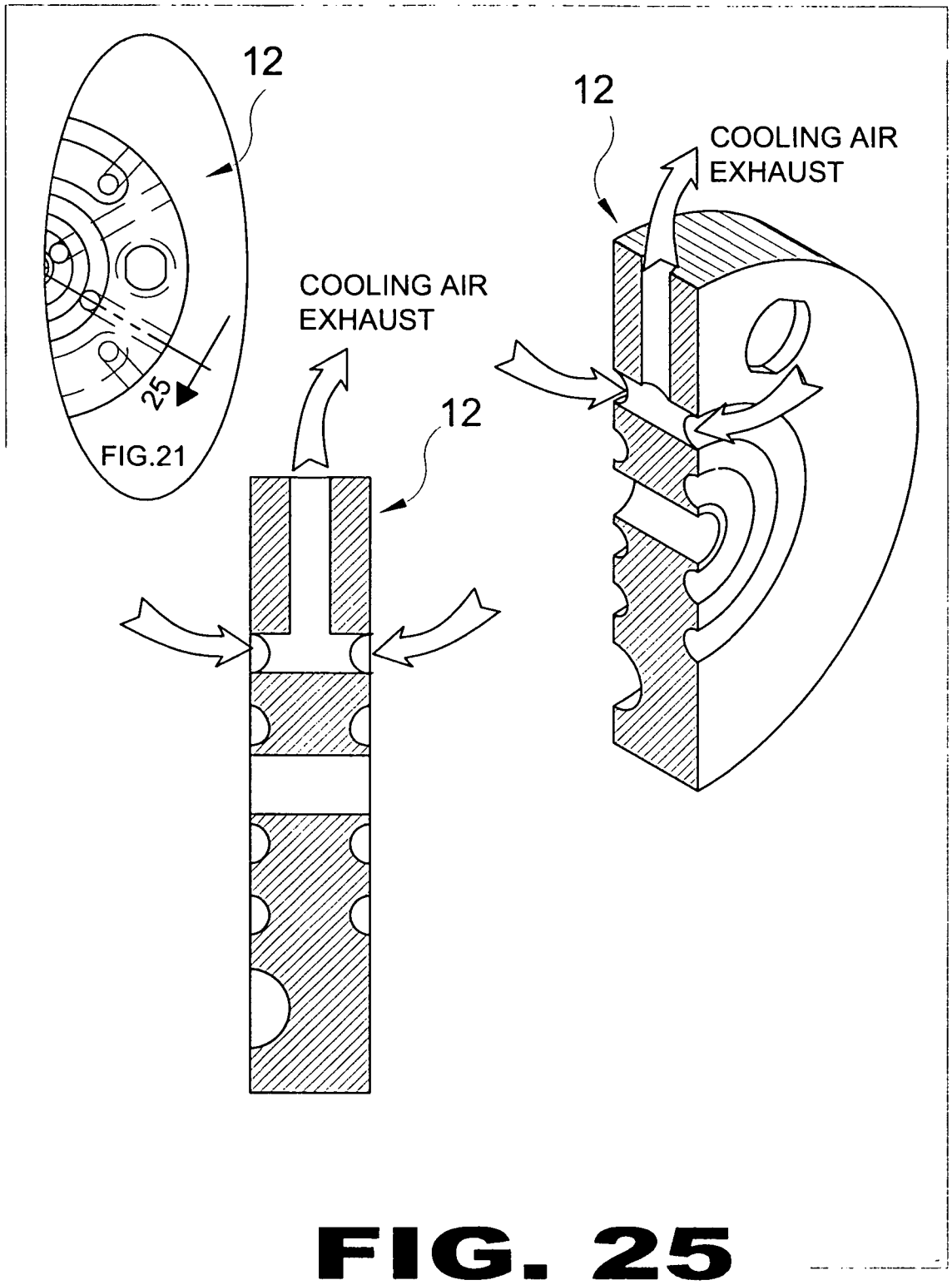
FIG. 25 is a cross sectional view of the header plate cooling air intake port.

FIG. 25 is a cross sectional view of the header plate 12 exhaust port.

Figure 26:
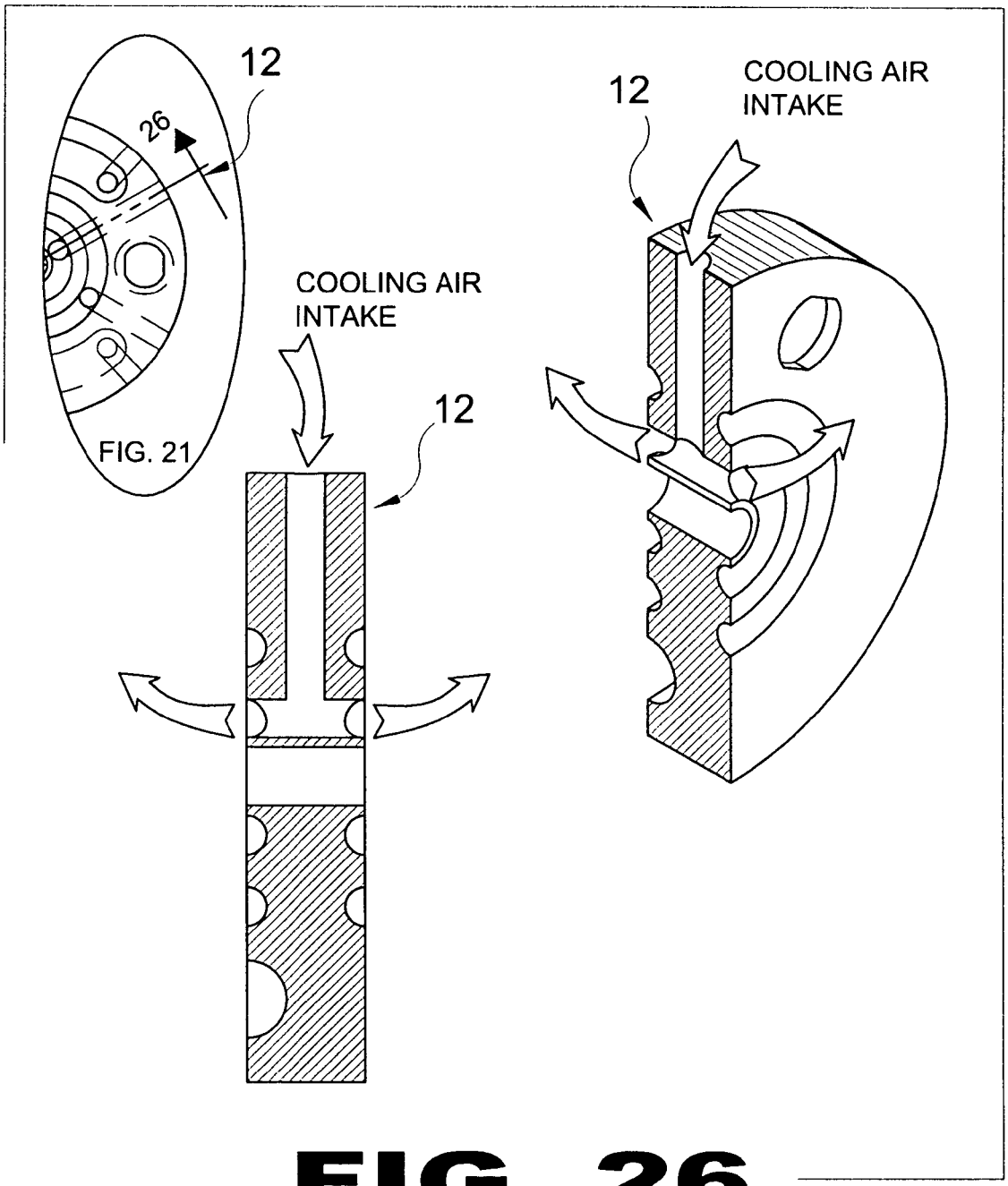
FIG. 26 is a cross sectional view of the header plate cooling air exhaust port.

FIG. 26 is a cross sectional view of the header plate 12 cooling air intake port.

Figure 27:
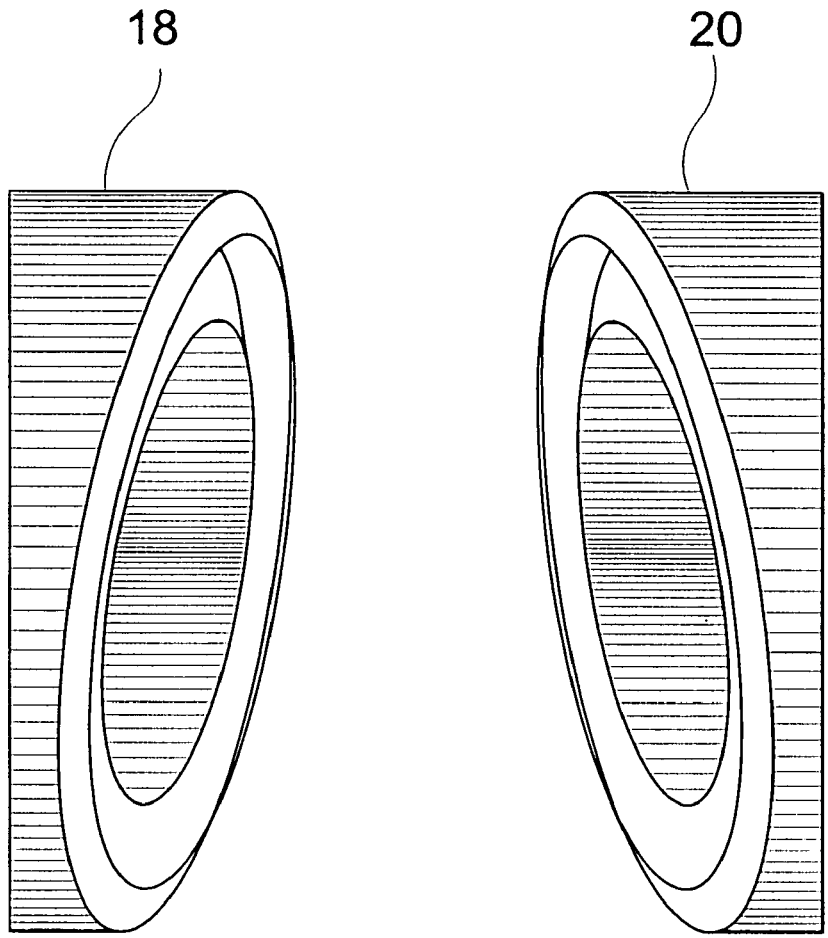
FIG. 27 is an elevation view of the cam plate.

FIG. 27 is an elevation view of the cam plates 18,20. The cam plates 18, 20 provide the linear motion for the piston assemblies as they rotate with the cylinder blocks. The cam followers are guided by a track in the surface of the cam plate.

Figure 28:
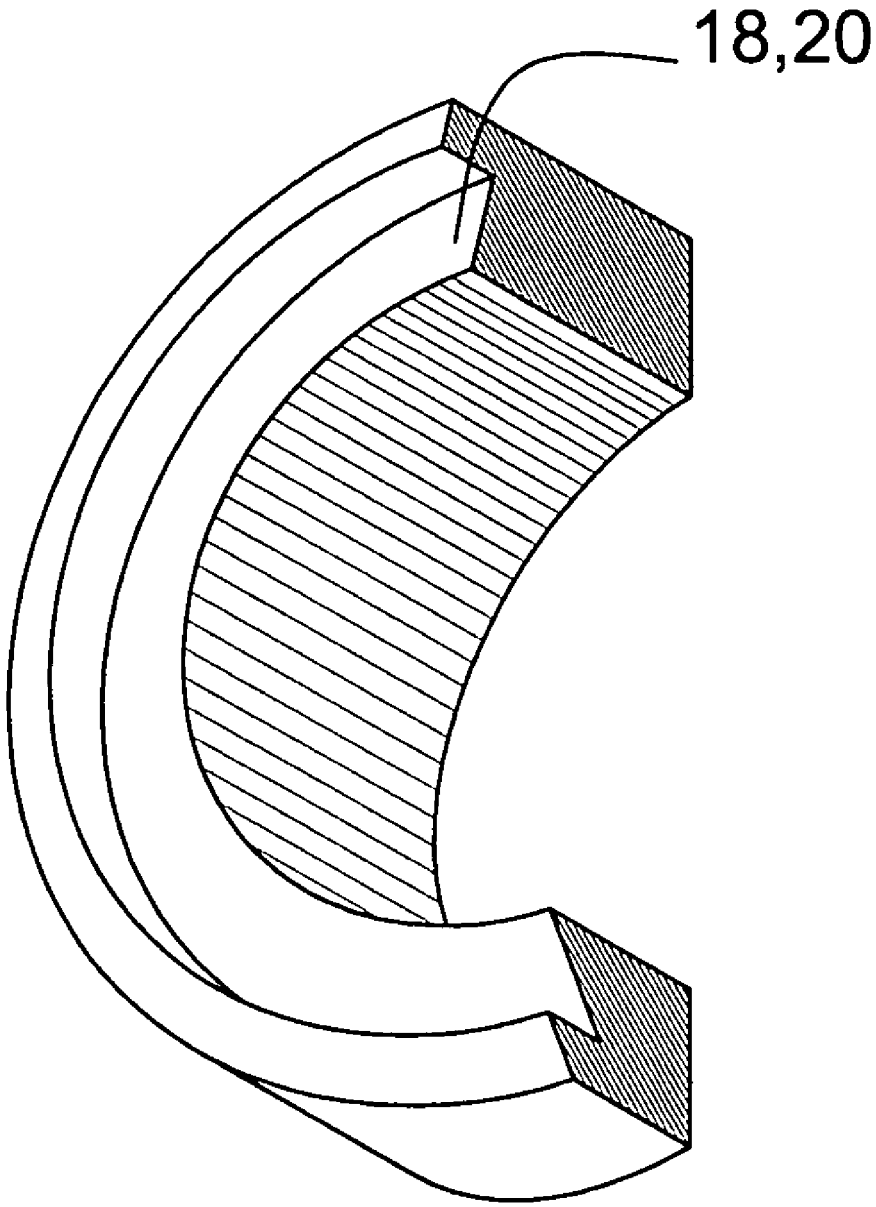
FIG. 28 is an isometric cross-sectional view of the cam plate.

FIG. 28 is an isometric cross-sectional view of a cam plate 18,20.

Figure 29:
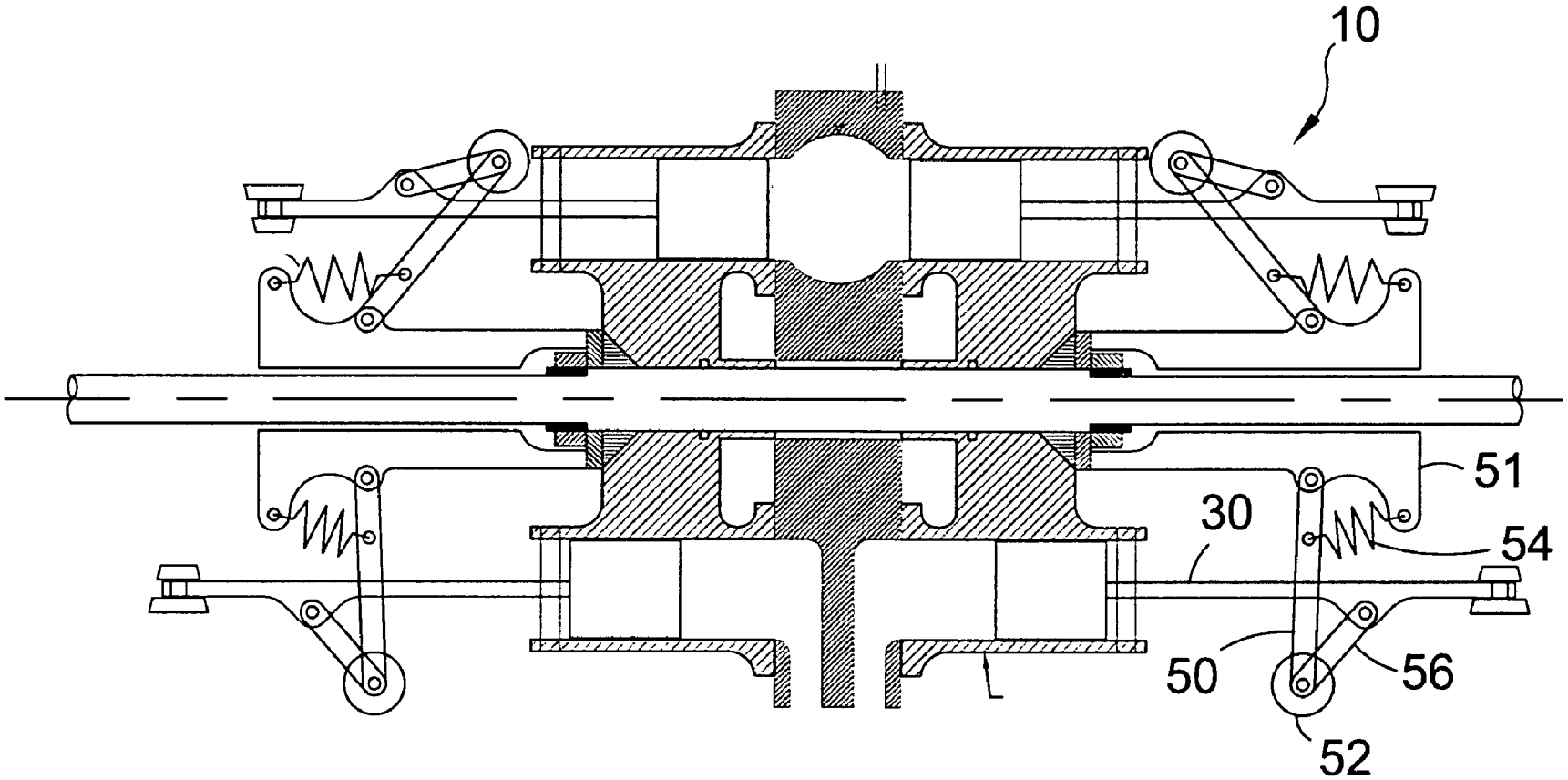
FIG. 29 is a sectional view of an alternate piston assembly.

FIG. 29 is a sectional view of the present invention 10 having an alternate piston assembly 26. The swing arms 50 replace the compression springs on the original design. The counter weight 52 is subject to a centripetal force from the spinning motion of the counter weights 52 proportional to the engine speed. The swing arm 50 and push arm 56 link this force which is orientated radially outward. The piston assemblies 26 create a "downward" force on the cam plate. The tension spring 54 keeps the swing arm 50 in position during startup.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A compression ignition rotating cylinder engine comprising:

a pair of opposing cylinder blocks, each said cylinder block having a plurality of piston through bores extending therethrough and arranged in a polar array proximal to the periphery thereof;

a plurality of piston assemblies corresponding to the number of throughbores in said cylinder blocks;

a fixed header plate sandwiched between said cylinder blocks comprising an exhaust port, an intake port and a combustion chamber common to said opposing pistons;

a pair of opposing cam plates having cam follower tracks;

means for injecting fuel into said combustion chamber; and a drive shaft;

wherein said piston assembly comprises:

a piston head;

a piston rod extending from said piston head and having a stop member near the distal end thereof;

a rotating wheel member forming a cam follower disposed at the distal end of said piston rod;

an elongate slider throughbore extending through a medial portion of said piston rod towards said piston head;

a slider pin for insertion through said slider throughbore;

a spring member disposed around said piston rod; and means for lubricating moving components;

wherein said piston heads reside reciprocatively within said piston bores;

wherein said slider pins extend into their respective cylinder blocks on each side of said slider rod and are retained fixedly therein thereby aligning said slider rods during their back and forth motion; and wherein said springs apply a bias to said stop members of said piston rods to urge said piston rods away from said header plate to maintain pressure of said cam followers against said cam plate.

2. A compression ignition rotating cylinder engine as recited in claim 1, wherein said cam plates have a cam track along which said cam followers travel during operation.

3. A compression ignition rotating cylinder engine as recited in claim 2, wherein the narrowest portions of said cam plates are situated in line with said exhaust port and said intake port and the thickest portions of said cam plates are in line with said combustion chamber.

4. A compression ignition rotating cylinder engine as recited in claim 3, wherein said piston assemblies are arranged with a first piston array of compression piston assemblies and an opposing second piston array of expansion piston assemblies with each said expansion piston assembly being aligned and paired with a corresponding compression piston assembly so that each pair of pistons move along their respective cam plates simultaneously and in unison.

5. A compression ignition rotating cylinder engine as recited in claim 4, wherein said intake port is located on the compression piston side of said header plate and said exhaust port is located on the expansion piston side thereof.

6. A compression ignition rotating cylinder engine as recited in claim 1, wherein said drive shaft wherein said first end of said drive shaft and said second end have spline fins that reside within said cylinder blocks thereby enabling said drive shaft to be driven by said cylinder blocks.

7. A compression ignition rotating cylinder engine as recited in claim 1, wherein said compression pistons compress the air during the rotation of said cylinder block and the compressed air is introduced into said combustion chamber at a volatile temperature wherein said fuel is also introduced therein simultaneously and the expelled gases force said expansion pistons away to provide the rotative energy for turning said cylinder block and said drive shaft.

8. A compression ignition rotating cylinder engine comprising:

a pair of opposing cylinder blocks, each said cylinder block having a plurality of piston through bores extending therethrough and arranged in a polar array proximal to the periphery thereof;

a plurality of piston assemblies corresponding to the number of throughbores in said cylinder blocks;

a fixed header plate sandwiched between said cylinder blocks comprising an exhaust port, an intake port and a combustion chamber common to said opposing pistons;

a pair of opposing cam plates having cam follower tracks;

means for injecting fuel into said combustion chamber;

a drive shaft; and wherein said piston assembly comprises:

a swing arm support extending from said cylinder block;

a swing arm having a proximal end pivotally attached to said swing arm support in perpendicular fashion therewith;

a counterweight attached to the distal end of said swing arm;

a push arm extending angularly from the distal end of said swing arm towards said cam plate with the distal end thereof pivotally attached to said piston rod; and a tension spring communicating between a medial portion of said swing arm and said sing arm support thereby providing a bias to pull said piston rod and said piston head towards said cam plate.

9. A compression ignition rotating cylinder engine as recited in claim 8, wherein said counter weight is subject to a centripetal force from the spinning motion of the weight proportional to the engine speed, said swing arm and said push arm link this force which is oriented radially outward to provide a stronger bias against said cam plate.

* * * * *